US012571618B2

(12) United States Patent
Miska

(10) Patent No.: US 12,571,618 B2
(45) Date of Patent: Mar. 10, 2026

(54) LAUNCH INITIATED LOW-DRAG SEEKER WINDOW COVER

(71) Applicant: BAE Systems Information and Electronic Systems Integration Inc., Nashua, NH (US)

(72) Inventor: Jacob W. Miska, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 253 days.

(21) Appl. No.: 18/498,623

(22) Filed: Oct. 31, 2023

(65) Prior Publication Data

US 2025/0136297 A1 May 1, 2025

(51) Int. Cl.
*F42B 10/46* (2006.01)

(52) U.S. Cl.
CPC ..... *F42B 10/46* (2013.01)

(58) Field of Classification Search
CPC ..... F42B 10/46; F42B 15/00; F42B 15/01; F42B 15/10; F41G 7/008; F41G 7/22; B64C 7/00
See application file for complete search history.

(56) References Cited

U.S. PATENT DOCUMENTS 3,637,166 A * 1/1972 Nicholson ..... B64D 45/00 244/121
3,674,227 A * 7/1972 Jacobson ..... F42B 10/46 102/293
4,275,859 A * 6/1981 Bleday ..... B64C 1/38 244/121
4,549,464 A * 10/1985 Hawkins ..... F42B 10/46 102/293
4,867,357 A * 9/1989 Inglis ..... F42B 15/36 102/377
4,944,226 A 7/1990 Wedertz et al.
5,159,151 A * 10/1992 Dransfield ..... F42B 15/36 102/377
5,220,159 A * 6/1993 Friedenthal ..... G01J 1/0411 356/121

(Continued)

FOREIGN PATENT DOCUMENTS

FR 2074186 A5 * 10/1971 ..... F42B 10/46
WO WO-2011141527 A1 * 11/2011 ..... F42B 10/46

OTHER PUBLICATIONS

International Search Report, PCT/US24/52523, mailed Aug. 20, 2025, 10 pages.

*Primary Examiner* — Benjamin P Lee
(74) *Attorney, Agent, or Firm* — Sand, Sebolt & Wernow LPA; Gary Mcfaline McFaline

(57) ABSTRACT

A guided vehicle that includes a body, a propulsion system operably engaged inside of the body, a housing operably engaged with the body and encasing a guidance device inside of the housing, a viewing window of the guidance device, and a cover moveably engaged with the housing, wherein the cover is moveable between a pre-flight configuration and a flight configuration. In the pre-flight configuration, the cover covers the viewing window. In the flight configuration, the cover is configured to expose the viewing window in the flight configuration in response to an impulse of acceleration generated by a launch of the guided vehicle.

16 Claims, 18 Drawing Sheets

(56) References Cited

U.S. PATENT DOCUMENTS 5,261,629 A * 11/1993 Becker ..... F42B 15/01 102/213
5,463,957 A * 11/1995 Jensen ..... G02B 6/4457 102/293
5,464,172 A * 11/1995 Jensen ..... B29C 70/207 102/293
6,388,184 B1 * 5/2002 Glenning ..... F42B 19/005 89/1.809
6,854,393 B2 * 2/2005 Hazan ..... F42B 15/34 102/501
7,093,799 B1 * 8/2006 Dulat ..... F42B 10/46 244/119
8,026,465 B1 9/2011 Fraysse
8,058,595 B2 * 11/2011 Koehler ..... F42B 10/46 244/121
8,333,151 B2 * 12/2012 Krisher ..... F42B 10/46 102/378
8,461,501 B2 * 6/2013 Williams ..... F42B 10/60 343/872
8,497,456 B2 * 7/2013 Eisentraut ..... F42B 15/36 342/61
8,519,312 B1 * 8/2013 Merems ..... F42B 15/36 244/119
8,686,327 B2 * 4/2014 Yacobovitch ..... F42B 10/46 244/130
8,931,738 B2 * 1/2015 White ..... F42B 15/10 244/129.4
10,030,952 B1 * 7/2018 Stofko ..... F42B 10/46
12,066,276 B2 * 8/2024 Bugge ..... F42B 14/06
2009/0314890 A1 * 12/2009 Koehler ..... F42B 12/76 244/119
2012/0248236 A1 10/2012 Eisentraut
2014/0014765 A1 * 1/2014 Sancho Ponce ..... F42B 15/01 250/239
2019/0041178 A1 * 2/2019 Choiniere ..... F42B 15/08
2021/0333074 A1 10/2021 Merems et al.

* cited by examiner

LAUNCH INITIATED LOW-DRAG SEEKER WINDOW COVER

TECHNICAL FIELD

The present disclosure generally relates to a cover of a guided vehicle that is configurable between a pre-flight configuration and a flight configuration for protecting a viewing window of a seeker device equipped to the projectile.

BACKGROUND ART

In military operations, modern projectiles or ballistic devices being launched from various platforms, including mobile and stationary vehicles, may be equipped with at least one guidance kit for guiding these projectiles to a desired target or point of interest. However, these platforms may be loaded with various types of projectiles or ballistic devices having various types of guidance kits and/or systems for neutralizing desired targets or point of interests. As such, these platforms may be loaded with at least one set or group of projectiles that is equipped with a first guidance kit type and at least another set or group of projectiles that is equipped with a second guidance kit that is similar to or disguisable from the first guidance kit type.

In one particular instance, a projectile may be equipped with a seeker device or similar nose-mounted imaging device. In operation, this imaging device may be configured to search and detect an aerial target at a desired viewing angle when in flight by measuring various light wavelengths emitted by an aerial targets, including, but not limited to, infrared wavelengths, visible light wavelengths, and ultraviolet wavelengths. Such measuring of these various light wavelengths is viewed through a protective viewing window or screen that is positioned at the foremost end of the projectile. By being positioned at the foremost end of the projectile, the imaging device may have a clear, unencumbered view of the far field environment relative to the projectile.

However, in current military operations, the placement of this viewing window may become detrimental to guidance operations performed by the imaging device. In one instance, the viewing window may be exposed to soot and other debris exhausted from a rocket missile of an adjacent projectile once the adjacent projectile is launched from a platform. With such exposure, the viewing window of the imaging device may become encumbered with this soot and other rocket debris thus restricting the viewing capability of the imaging device. In another instance, the viewing window is also exposed to the external environment surrounding the platform when in flight, which could result in unwanted debris or material crashing into the viewing window of the imaging device. With such exposure, the viewing window of the imaging device may become damaged and/or marred thus restricting the viewing capability of the imaging device. While platforms may be fitted with protective tubes or housing to house and protect the projectiles, such protective housing may add unnecessary weight to the platform, reduce the overall aerodynamics of the platform, and reduce the overall number of projectiles and/or payloads that may equipped to the platform.

SUMMARY OF THE INVENTION

In one aspect, an exemplary embodiment of the present disclosure may provide a guided vehicle. The guided vehicle includes a body; a propulsion system operably engaged inside of the body; a housing operably engaged with the body and encasing a guidance device inside of the housing; a viewing window of the guidance device; and a cover moveably engaged with the housing, wherein the cover is moveable between a pre-flight configuration and a flight configuration, wherein the cover covers the viewing window in the pre-flight configuration. The cover is configured to expose the viewing window in the flight configuration in response to an impulse of acceleration generated by a launch of the guided vehicle.

This exemplary embodiment or another exemplary embodiment may further include that the covers transitions from the pre-flight configuration to the flight configuration in response to experiencing a predetermined impulse of acceleration of the guided vehicle. This exemplary embodiment or another exemplary embodiment may further include that the cover comprises: a sleeve slidably engaged with the housing; and a set of first flaps moveably engaged with the sleeve. This exemplary embodiment or another exemplary embodiment may further include that the housing comprises: a front end; a rear end longitudinally opposite to the front end; and a stop disposed between the front end and the rear end. This exemplary embodiment or another exemplary embodiment may further include that when the cover is provided in the pre-flight configuration, the sleeve is positioned at the front end and is remote from the stop and the set of first flaps completely shields the viewing window of the guidance device. This exemplary embodiment or another exemplary embodiment may further include that when the cover is provided in the flight configuration, the sleeve is positioned between the front end and the rear end and is engaged with the stop and the set of first flaps is retracted away from the viewing window of the guidance device by an exterior surface of the housing. This exemplary embodiment or another exemplary embodiment may further include that when the cover is provided in the flight configuration, the sleeve is positioned between the front end and the rear end and is engaged with the stop and the set of first flaps is retracted away from the viewing window of the guidance device by an exterior surface of the housing. This exemplary embodiment or another exemplary embodiment may further include that housing further comprises: a set of cutouts defined in the housing between the front end and the stop; wherein each flap of the set of first flaps is disposed inside of a corresponding cutout of the set of cutouts and is even with an exterior surface of the housing when the cover is provided in the flight configuration. This exemplary embodiment or another exemplary embodiment may further include that the cover further comprises: a set of pivot pins, wherein each pivot pin pivotably engages one flap from the set of first flaps with the sleeve; wherein each flap of the set of first flaps is configured to individually pivot about the corresponding pivot pin. This exemplary embodiment or another exemplary embodiment may further include that the cover further comprises: a set of biasers operably engaged with the set of first flaps and the pivot pin; wherein the set of biasers is configured to bias the set of first flaps to the pre-flight configuration. This exemplary embodiment or another exemplary embodiment may further include that the cover further comprises: a set of second flaps movably engaged with the housing; a set of first pivot pins movably engaging the set of second flaps with the set of second flaps; and a set of biasers operably engaged with the set of second flaps and the set of pins; wherein the set of biasers is configured to bias the set of second flaps to the flight configuration. This exemplary embodiment or another exemplary embodiment may further include that when the cover is provided in the pre-flight configuration, the set of second flaps is maintained inside of the sleeve. This exemplary embodiment or another exemplary embodiment may further include that when the cover is provided in the flight configuration, the set of second flaps transitions outwardly away from the housing in response to the sleeve disengaging from the set of second flaps and fits between the set of first flaps. This exemplary embodiment or another exemplary embodiment may further include that the second set of flaps is maintained inside of the sleeve and transitions outwardly away from the housing as the sleeve transitions from the front end position to the rear end position. This exemplary embodiment or another exemplary embodiment may further include a set of grooves defines in the housing; and at least one guide bracket operably engaged with the sleeve and with the housing inside of the set of grooves; wherein the at least one guide bracket is configured to lead the sleeve and the set of first flaps along the housing based on the engagement between the at least one guide bracket and the housing inside of the set of grooves.

In another aspect, an exemplary embodiment of the present disclosure may provide a method. The method includes steps of: providing a guided vehicle, wherein the guided vehicle includes a body, a propulsion system operably engaged inside of the body, and at least one guidance kit operably engaged with the body and includes at least a housing, a guidance device operably engaged with the housing, and a cover moveably engaged with the housing between a pre-flight configuration and a flight configuration; effecting a viewing window of the guidance device to be shielded, by the cover, from an external environment surrounding the guided vehicle in the pre-flight configuration; effecting the guided vehicle to be launched, by the propulsion system, at a predetermined impulse of acceleration; effecting the cover to transition along the housing from the pre-flight configuration to the flight configuration in response to the impulse of acceleration generated by the propulsion system; and effecting the viewing window of the guidance device to be revealed to the external environment.

This exemplary embodiment or another exemplary embodiment may further include that the step of effecting the cover to transition along the housing from the pre-flight configuration to the flight configuration further comprises: effecting a sleeve of the cover to slide along an outer surface of the housing. This exemplary embodiment or another exemplary embodiment may further include that the step of effecting the cover to transition along the housing from the pre-flight configuration to the flight configuration further comprises: effecting a set of first flaps to slide along the outer surface of the housing in conjunction with the sleeve; and effecting each flap of the set of first flaps to pivot outwardly in response to each flap of the set of first flaps traveling over the outer surface of the housing. This exemplary embodiment or another exemplary embodiment may further include a step of effecting a set of first flaps to be biased, by a set of biasers, to the pre-flight configuration. This exemplary embodiment or another exemplary embodiment may further include steps of effecting a set of first flaps to store into a set of cutouts defined in the housing when the cover is provided in the flight configuration; wherein the set of first flaps and an outer surface of the housing collectively define a continuous surface. This exemplary embodiment or another exemplary embodiment may further include a step of effecting a set of second flaps to be biased, by a set of biasers, outwardly away from the housing in response to the sleeve being removed from the set of second flaps. This exemplary embodiment or another exemplary embodiment may further include a step of effecting spaces to be filled in, by the set of second flaps, defined between adjacent flaps of the first set of flaps; wherein the set of first flaps, the set of second flaps, and the outer surface of the housing collectively define a continuous surface when the cover is provided in the flight configuration.

In yet another aspect, an exemplary embodiment of the present disclosure may provide a method. The method includes steps of providing a projectile, the projectile comprising: a body; a propulsion system operably engaged inside of the body; providing a protective cover kit, the protective cover kit comprising: a guidance device having a viewing window; a housing configured to encase the guidance device; and a cover moveably engaged with the housing between a pre-flight configuration and a flight configuration; protecting the viewing window by the cover in the pre-flight configuration; and engaging the protective cover kit with the body of the projectile.

This exemplary embodiment or another exemplary embodiment may further include that the step of engaging the protective cover kit with the body further comprises: threading the housing of the protective cover kit with the body of the projectile.

In yet another aspect, an exemplary embodiment of the present disclosure may provide a protective cover kit for a guided vehicle. The protective cover kit includes a guidance device having a viewing window; a housing configured to encase the guidance device; and a cover moveably engaged with the housing between a pre-flight configuration and a flight configuration, wherein the cover covers the viewing window in the pre-flight configuration; wherein the cover is configured to expose the viewing window in the flight configuration in response to an impulse of acceleration generated by a launch of the guided vehicle.

This exemplary embodiment or another exemplary embodiment may further include that the cover comprises: a sleeve slidably engaged with the housing; and a set of first flaps moveably engaged with the sleeve. This exemplary embodiment or another exemplary embodiment may further include that the housing comprises: a front end; a rear end longitudinally opposite to the front end; and a stop disposed between the front end and the rear end. This exemplary embodiment or another exemplary embodiment may further include that the sleeve is slidable between a front end position remote from the stop and a rear end position adjacent to the stop; and wherein the set of first flaps retract from the viewing window as the sleeve transitions from the front end position to the rear end position. This exemplary embodiment or another exemplary embodiment may further include that the cover further comprises: a set of pivot pins, wherein each pivot pin pivotably engages one flap from the set of first flaps with the sleeve; wherein each flap of the set of first flaps is configured to individually pivot about the corresponding pivot pin. This exemplary embodiment or another exemplary embodiment may further include that the cover further comprises: a set of biasers operably engaged with the set of first flaps and the pivot pin; wherein the set of biasers is configured to bias the set of first flaps to the pre-flight configuration. This exemplary embodiment or another exemplary embodiment may further include that cover further comprises: a set of second flaps movably engaged with the housing; a set of first pivot pins movably engaging the set of second flaps with the set of second flaps; and a set of biasers operably engaged with the set of second flaps and the set of pins; wherein the set of biasers is configured to bias the set of second flaps to the flight configuration.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
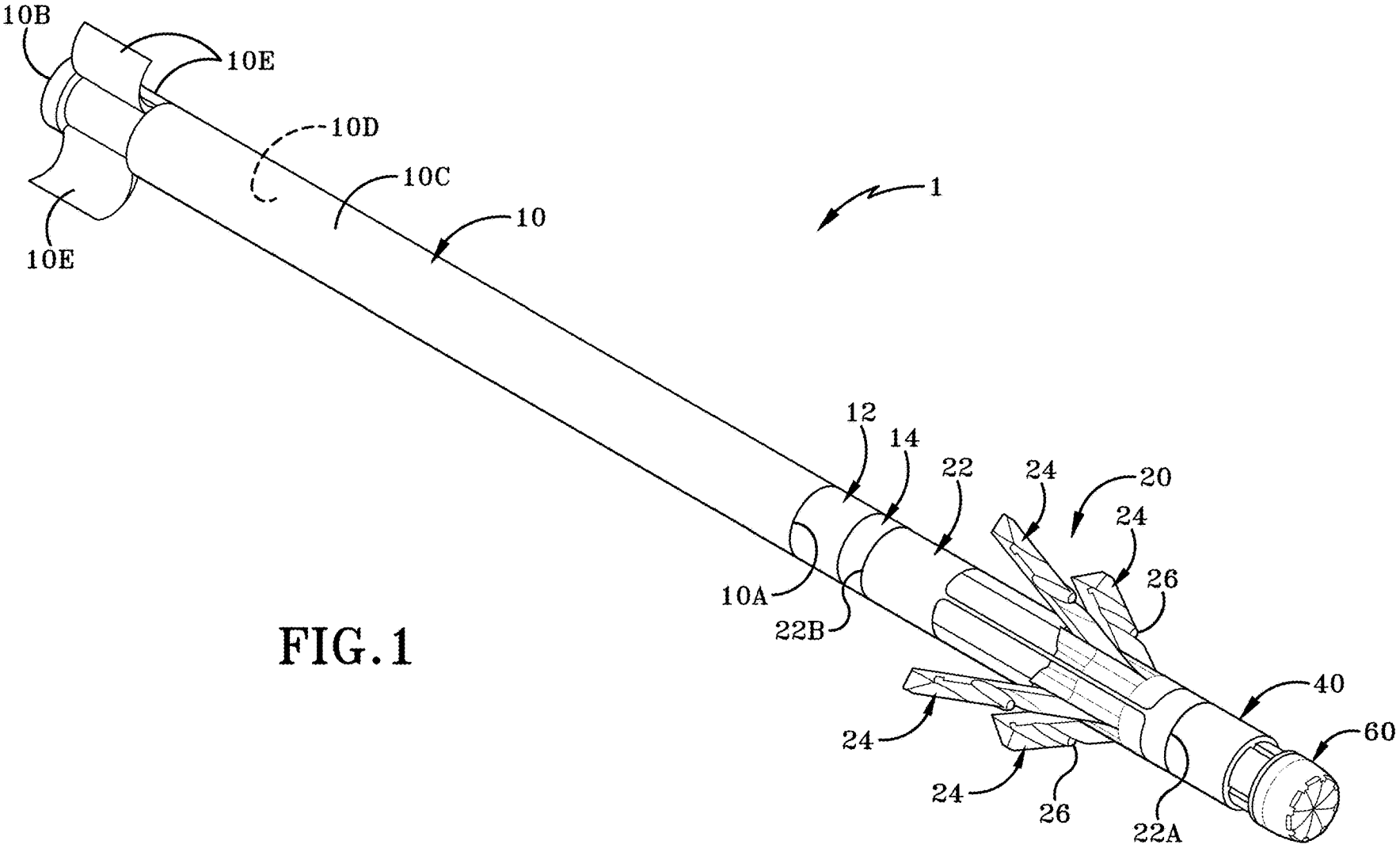
FIG. 1 is a front, top, first side isometric perspective view of a projectile in accordance with one aspect of the present disclosure, wherein the projectile is equipped with a cover to protect an imaging device in a pre-flight configuration.

FIG. 1 illustrates a projectile, ballistic device, or guided vehicle 1 that may be equipped with a guidance kit for guiding the illustrated projectile 1 to a specific target. As provided herein, the illustrated projectile 1 is a Hydra 70 rocket equipped at least two guidance kits for guiding the illustrated projectile 1 to a specific target, which are discussed in greater detail below. It should be understood that projectile 1 may be any type of moveable device regardless of whether it is a munition. For example, the projectile 1 could also be any manned or unmanned object that needs guidance in the manner discussed herein. Such use and purpose of the at least two guidance kits with the illustrated projectile 1 are described in more detail below.

In the present disclosure, projectile 1 is configured to be launched from a ground-based or ground-vehicle platform towards a desired airborne or ground-based target. It will be understood that the platform discussed herein is exemplary only and any type of platform is contemplated to be represented. In one exemplary embodiment, the platform described herein may be represented as an aircraft or air vehicle (e.g., fixed-wing aircraft or rotary-wing aircraft that is manned or unmanned) that is capable of launching projectiles and other similar payloads from air and striking targets in air, on land, or at sea. In another exemplary embodiment, the platform described herein may be represented as hand-held launcher, a launcher fixed to a ground transporting vehicle, a launcher fixed to a naval vehicle, or other suitable launchers for launching projectiles and other similar devices from land or sea and striking targets on land or sea. In another exemplary embodiment, the platform described herein may be a ground launch vehicle that is operably engaged with a ground surface and is configured to launch surface-to-surface projectiles or missiles (or "SSM"), ground-to-ground projectiles or missiles (or "GGM"), or surface-to-air projectiles or missiles. Stated differently, the exemplary platform is capable of launching projectiles and other similar devices from land and striking targets in the air or on land or sea.

The projectile 1 may include a rocket motor or engine 10 configured to provide suitable propulsion and thrust needed for a desired military operation. The rocket motor 10 generally includes a first or front end 10A, a second or rear end 10B opposite to the first end 10A, and a longitudinal axis defined therebetween. The rocket motor 10 also generally includes a cylindrical wall 10C that extends between the first end 10A and the second end 10B along the longitudinal axis of the rocket motor 10. While not illustrated herein, suitable rocket propellants and elements may be stored inside of the cylindrical wall 10C (e.g., a chamber 10D defined inside of the cylindrical wall 10C) that generate propulsion and thrust for the rocket motor 10. The rocket motor 10 also includes an aft fin member 10E operably engaged with the cylindrical wall 10C proximate to the second end 10B of the rocket motor 10. The aft fin member 10E may provide flight assistance to the projectile 1 at the second end 10B of the rocket motor 10 as the projectile 1 travels through the air between the initial launch at the platform 2 and a desired target.

Projectile 1 also includes a warhead 12 with an impact-detonating fuse 14. As best seen in FIG. 1, the combination of the warhead 12 and impact-detonating and proximity fuse 14 threadably engage with the first end 10A of rocket motor 10. As such, the combination of the warhead 12 and impact-detonating fuse 14 are positioned ahead of and/or forward of the rocket motor 10. While the combination of the warhead 12 and impact-detonating fuse 14 are positioned ahead of and/or forward of the rocket motor 10, a combination of a warhead and an impact-detonating fuse may be positioned at any suitable position along a projectile described and illustrated herein. In one exemplary embodiment, a combination of a warhead and an impact-detonating fuse may be positioned between a seeker device described and illustrated herein and a guidance device such that the guidance device, the combination of the warhead and the impact-detonating fuse, and the seeker device may be a unitary, monolithic device that is assembled in a projectile.

Projectile 1 may also include a thermal battery or power source. If included, thermal battery may provide a desired amount of power to any electrical devices and/or assemblies included in projectile 1 that are described and illustrated herein once projectile 1 is in flight.

In the illustrated embodiment, the rocket motor 10 of the projectile 1 may be a standard 2.75-inch rocket motor (e.g., liquid-fueled rocket motors, solid-fueled rocket motors, or other suitable rocket motors of the like). In other exemplary embodiments, any suitable rocket motor may be equipped for a projectile based on the mission and/or objective.

Projectile 1 also includes a first guidance kit or apparatus (hereinafter "first guidance kit") generally referred to as 20 that is configured to guide the projectile 1 to a specific target. The first guidance apparatus 20 may include legacy hardware and guidance programs that are configured to initiate and/or deploy on-board devices to guide and/or direct the projectile 1 to a specific target. The first guidance apparatus 20 is also configured to operably engage a rocket motor, such as rocket motor 10, to enable guidance capabilities to the rocket motor. As described above, the first guidance apparatus 20 provided with the projectile 1 is a legacy guidance kit and/or apparatus. In one example, the legacy guidance kit described and illustrated herein may be an Advanced Precision Kill Weapon System (APKWS) laser guidance kit manufactured by BAE Systems. In another example, the legacy guidance kit described and illustrated herein may be a preexisting or legacy guidance kit that includes commercially-available navigation equipment and/or instruments, including inertial navigation systems or inertial measurement units, for guiding and steering a projectile to a desired target.

Figure 2:
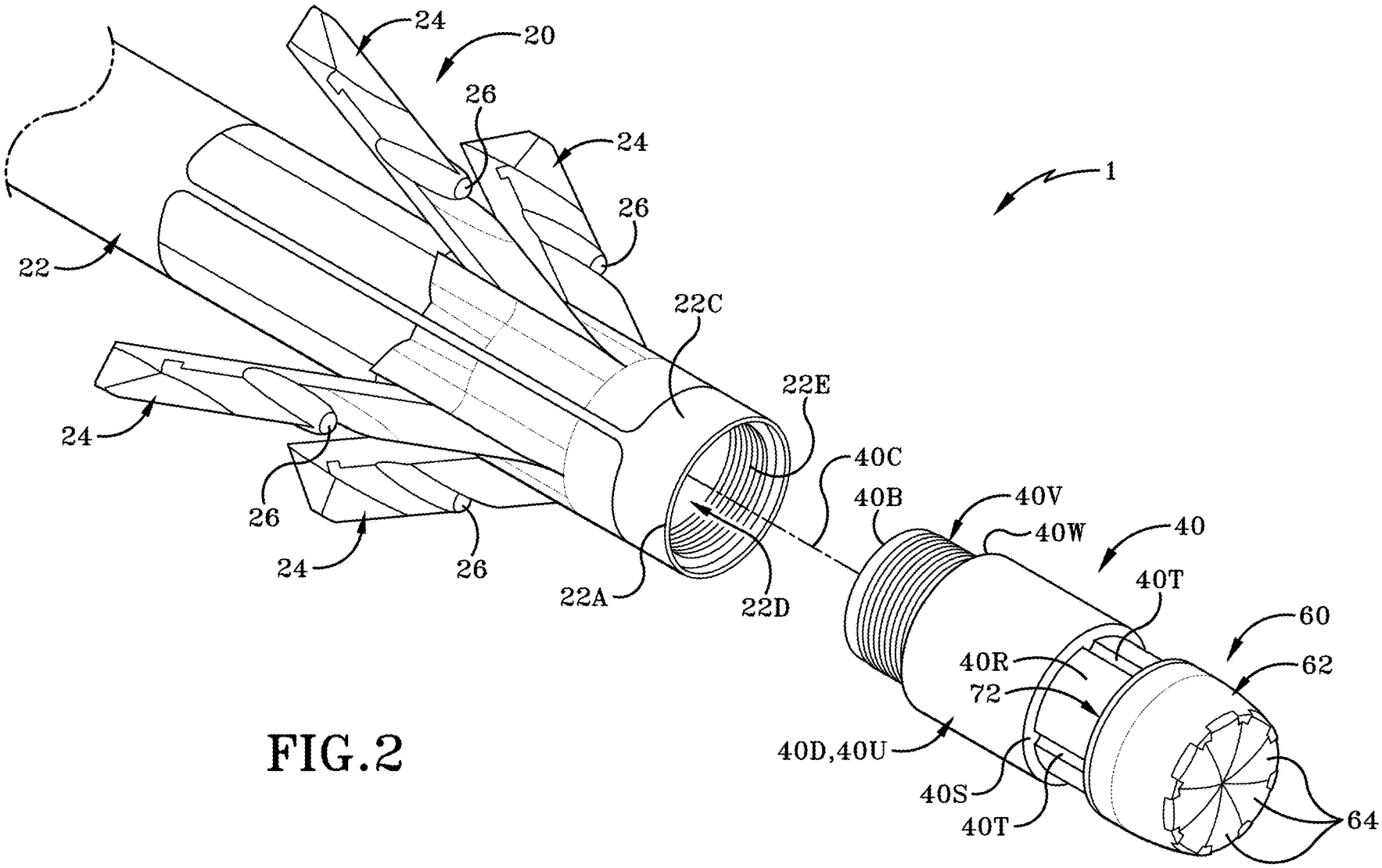
FIG. 2 is an exploded view of the projectile, wherein a housing and the cover are exploded away from a body of a first guidance kit of the projectile.

With respect to first guidance apparatus 20, first guidance apparatus 20 includes a body 22 that operably engages with the rocket motor 10 and houses the electrical components and/or device of first guidance apparatus 20. As best seen in FIG. 2, body 22 includes a first end 22A, a second end 22B that is longitudinally opposite to the first end 22A and operably engages with rocket motor 10, and a wall 22C extending longitudinally between the first end 22A and the second end 22B. Still referring to FIG. 2, body 22 also defines a chamber 22D that extends from the first end 22A to the second end 22B and is accessible at the first end 22A. Still referring to FIG. 2, body 22 also includes an internal threading 22E that extends into the wall 22C at the first end 22A and is positioned inside of the chamber 22D; such use of the internal threading 22E is discussed in greater detail below.

The first guidance apparatus 20 may also include a set of flaperons and/or wings 24 that operably engages with the body 22. As best seen in FIG. 1, each wing of the set of wings 24 is moveable on the body 22 when the projectile 1 is launched from a platform. More particularly, the set of wings 24 pivots outwardly from the body 22 and outside of the body 22 when the projectile 1 is launched and travels through the air. In one exemplary embodiment, each wing of a set of wings discussed herein may be fixed and remain stationary with a body of a first guidance kit such that each wing of the set of wings is free from moving relative to the body of the first guidance kit.

First guidance kit 20 may also include a set of optical imaging devices or seekers 26. As best seen in FIG. 2, each optical imaging device of the set of optical imaging device 26 operably engages with a corresponding wing of the set of wings 24. In the present disclosure, a portion of each optical imaging device of the set of optical imaging devices 26 is visible to the external environment and/or far field forward of the projectile 1. During operation, each optical imaging device of the set of optical imaging devices 26 is configured to visualize and detect one or more electromagnetic wavelengths (e.g., visible light or visible spectrum wavelengths, infrared wavelengths, ultraviolet wavelengths, etc.) of desired targets, particularly aircrafts and air vehicles in flight. In one instance, each optical imaging device of the set of optical imaging devices 26 may be a laser-based guidance device and/or sensor that is led by a laser device to a desired target or point-of-interest.

Figure 4A:
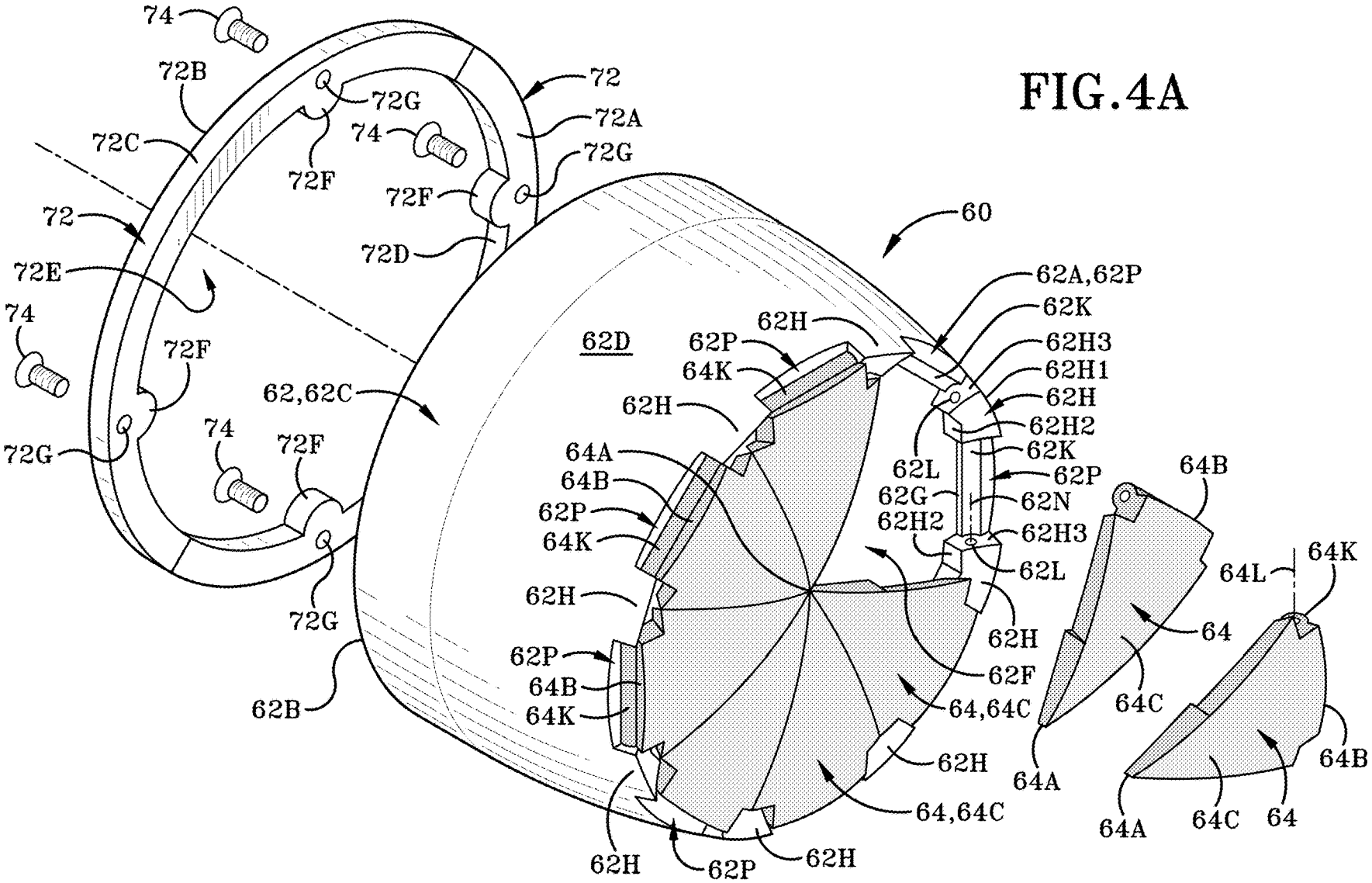
FIG. 4A is an exploded view of a sleeve of the cover, a set of first flaps of the cover, and a pair of guide brackets of the cover.
Figure 4B:
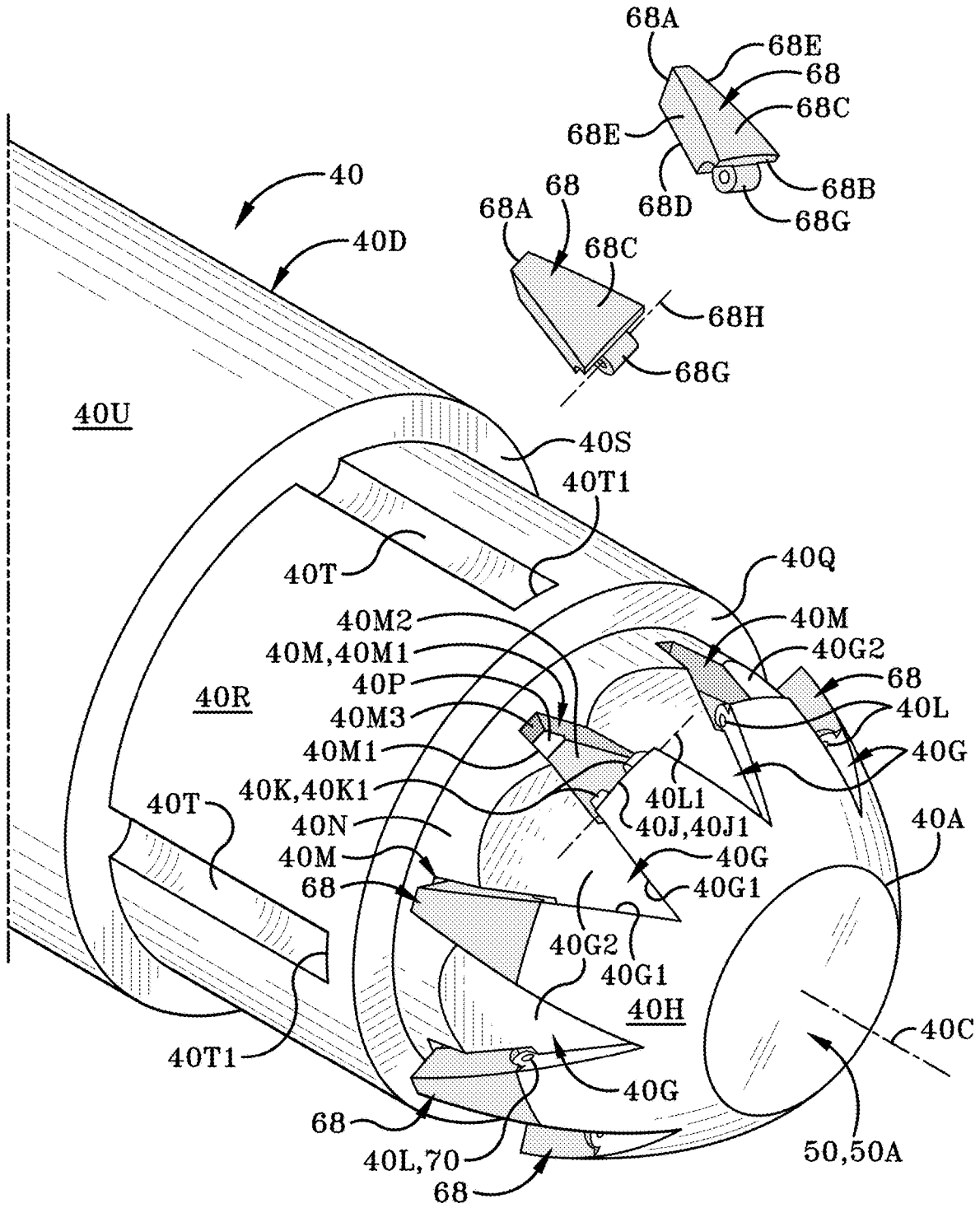
FIG. 4B is an exploded view of the housing and a set of second flaps of the cover.

Projectile 1 also includes housing or nose cone 40 that operably engages with the body 22 of the first guidance apparatus 20. As best seen in FIGS. 2 and 4B, housing 40 may include a front end 40A, a rear end 40B that operably engages with the body 22 of the first guidance apparatus 20 and is longitudinally opposite to the front end 40A, and a longitudinal axis 40C defined therebetween. Still referring to FIGS. 2 and 4B, housing 40 may also include a cylindrical wall 40D that extends along the longitudinal axis 40C between the front end 40A and the rear end 40B. Housing 40 may also define an interior surface 40E that extends entirely along the cylindrical wall 40D between the front end 40A and the rear end 40B (see FIGS. 8-9).

Figure 8:
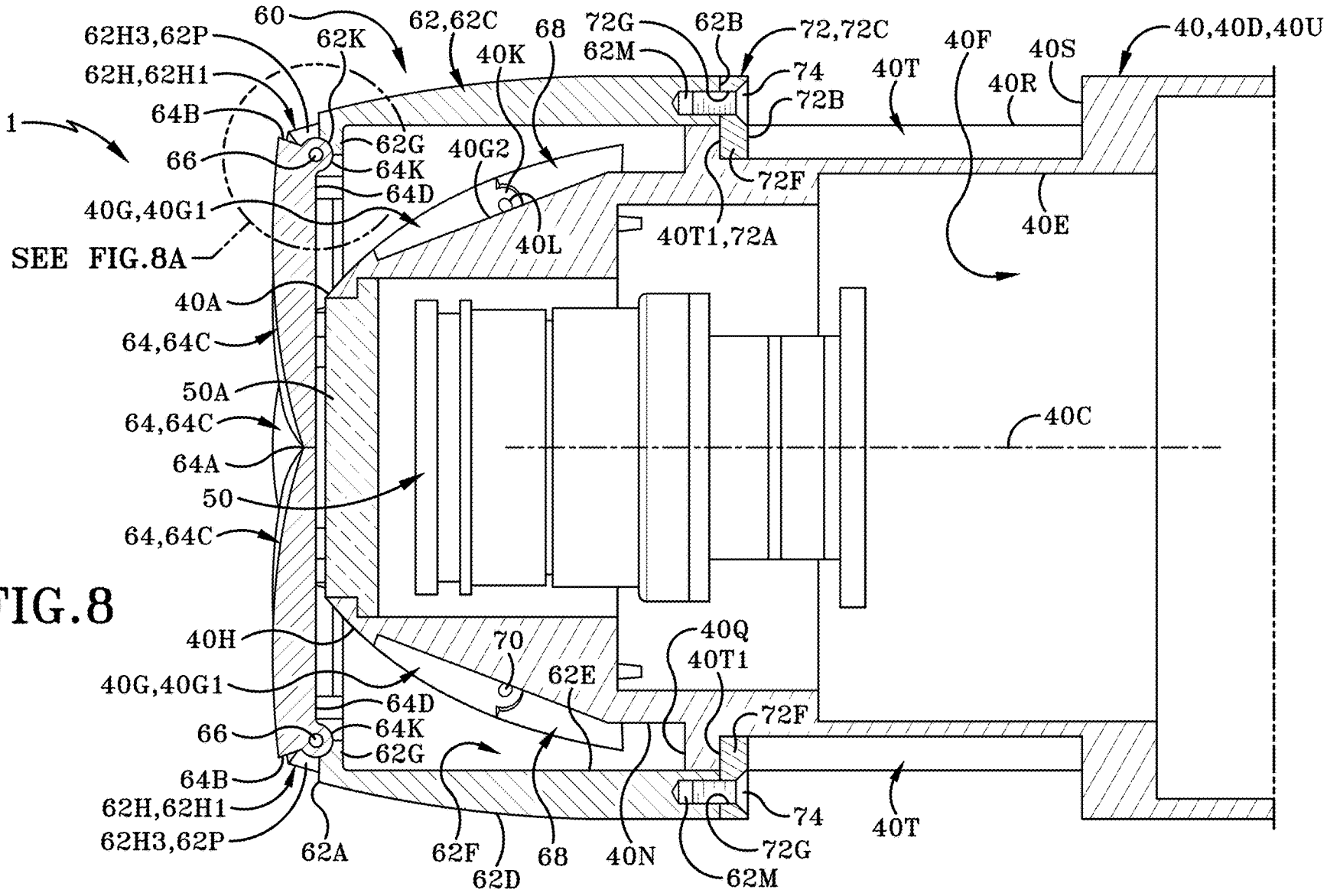
FIG. 8 is a longitudinal section view of the projectile showing the cover and a portion of the housing taken in the direction of line 8-8 in FIG. 7.
Figure 9:
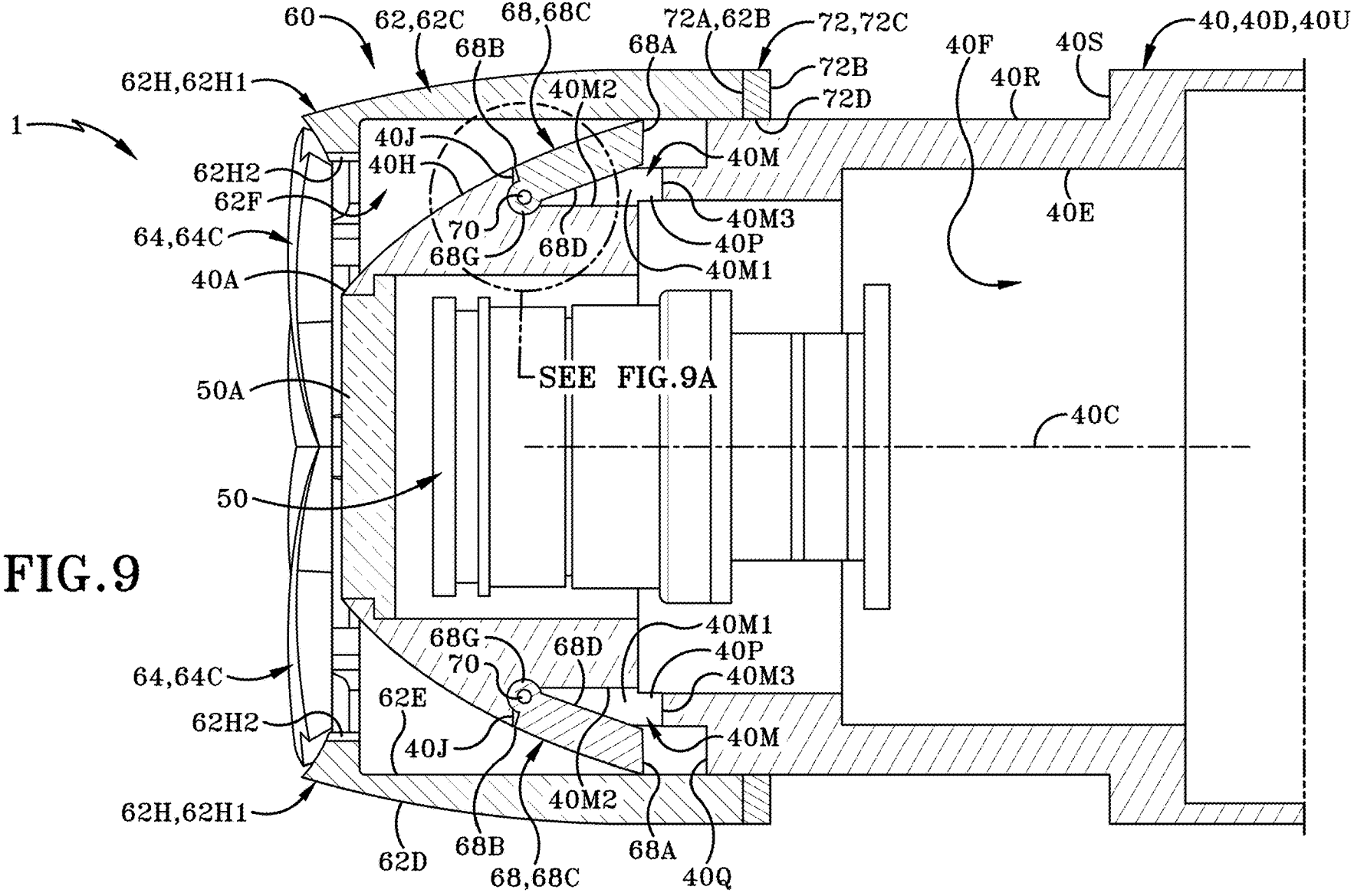
FIG. 9 is a longitudinal section view of the projectile showing the cover and a portion of the housing taken in the direction of line 9-9 in FIG. 7.

Housing 40 may also define a passageway 40F. As best seen in FIGS. 8-9, the passageway 40F is defined by the cylindrical wall 40D and extends entirely along the cylindrical wall 40D between the front end 40A and the rear end 40B. The passageway 40F is also accessible at either the front end 40A or the rear end 40B since both the front end 40A and the rear end 40B are open ends. In operation, the housing 40 is configured to house various assemblies and components of an imaging device inside of the passageway 40F for protection, which are described in greater detail below.

Housing 40 defines a set of cutouts 40G that extends downwardly into the housing 40 from a first outer surface 40H towards the interior surface 40E. As best seen in FIG. 4B, each cutout of the set of cutouts 40G is defined by a pair of upright walls 40G1 that extends downwardly from the first outer surface 40H to a base wall 40G2 that is defined below the first outer surface 40H. In the present disclosure, the walls of the pair of upright walls 40G1 are arranged at an acute angle with one another where the corresponding cutout of the set of cutouts 40G defines a V-shaped configuration; such use and purpose of the V-shaped configuration is discussed in greater detail below. In other exemplary embodiments, walls of the pair of upright walls 40G1 may be arranged at any suitable angle relative to one another to define a desired shape for a cutout of the set of cutouts 40G. In the present disclosure, each base wall 40G2 also defines a generally triangular shape when viewed from a side perspective (see FIG. 4B); such use and purpose of the generally triangular shape is discussed in greater detail below. In other exemplary embodiments, each base wall 40G2 may define any suitable shape dictated by the implantation and/or use of the base walls 40G2.

Figure 10A:
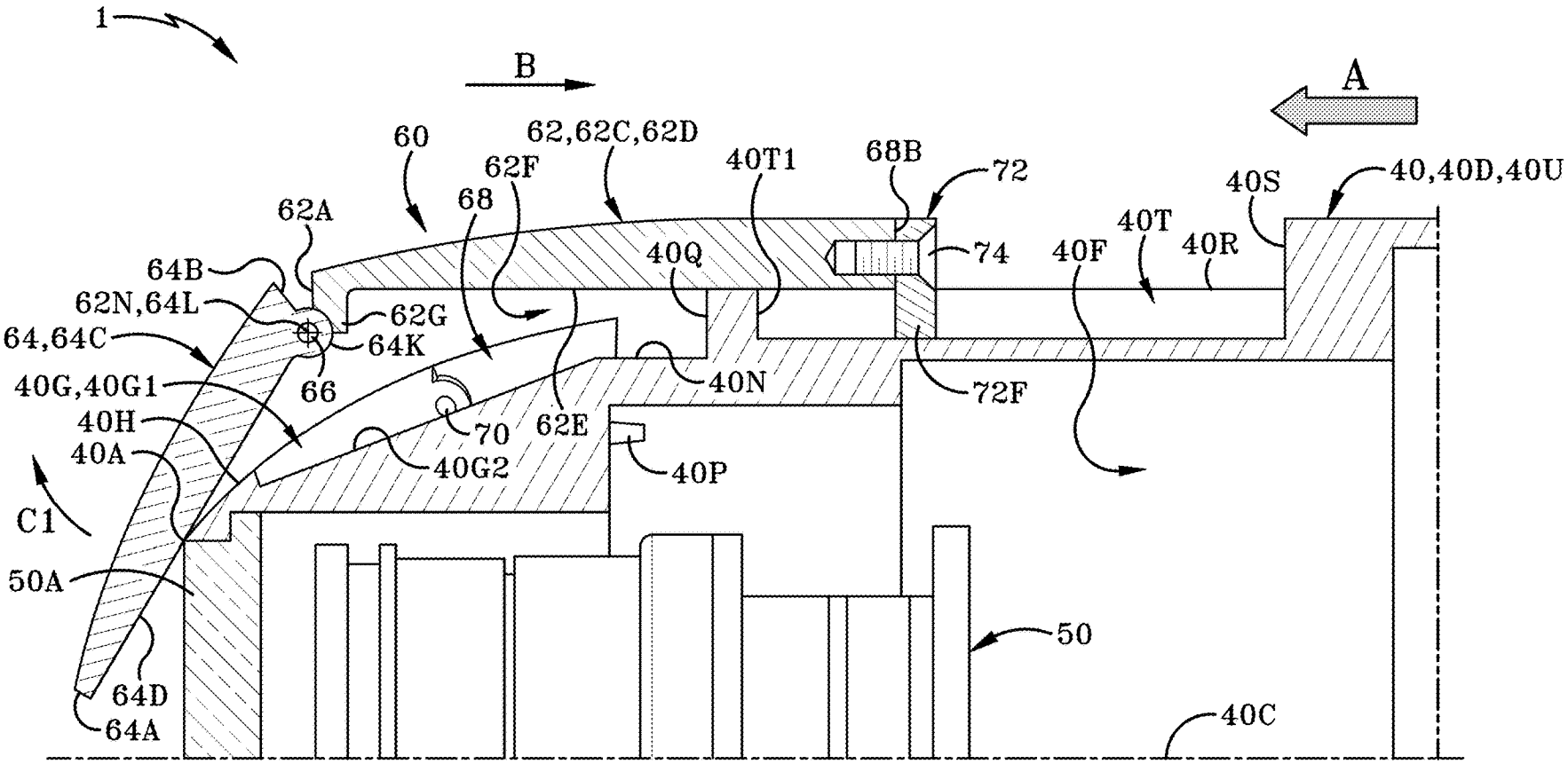
FIG. 10A is an operational view of the projectile being launched from a platform, wherein the cover begins to transition from the pre-flight configuration to the flight configuration in response to an impulse generated by a rocket motor of the projectile.

Housing 40 also includes a set of angled walls 40J. As best seen in FIGS. 4B and 10A, each angled wall of the set of angled walls 40J extends between a first upright wall of a first pair of upright walls 40G1 and an adjacent upright wall of a second pair of upright walls 40G1. In the present disclosure, the set of angled walls 40J is also positioned rearward of or behind the pairs of upright wall 40G1 that collectively define the set of cutouts 40G and are positioned between the set of base walls 40G2.

Housing 40 also includes a set of extensions 40K that extends outwardly from the set of angled walls 40J. As best seen in FIGS. 4B and 10A, a pair of extensions (e.g., first pair of extensions 40K1) from the set of extensions 40K extends outwardly from a corresponding angled wall (e.g., a first angled wall 40J1) of the set of angled walls 40J towards the rear end 40B of the housing 40. Each extension of the set of extensions 40K also defines an opening 40L that extends transversely through each extension of the set of extensions 40K (see FIG. 4B). A pivot axis 40L1 also extends through the opening 40L for indicating pivoting means provided by the opening 40L (see FIG. 4A), which is discussed in greater detail below. In the present disclosure, the openings 40L defined in each pair of extensions 40K are coaxial with one another so that the pair of extensions 40K may receive and engage with a pivot pin or pin for pivoting means, which are discussed in greater detail below. While a pair of extensions of the set of extensions 40K extends from and engage with an angled wall of the set of angled walls 40J, any suitable number of extensions may extend from and engage with an angled wall of the set of angled walls 40J as dictated by the implantation and/or use of the extension.

Housing 40 also defines a set of cavities 40M that extends downwardly into the housing 40 from a second outer surface 40N towards the interior surface 40E. As best seen in FIGS. 4B and 9, each cavity of the set of cavities 40M is defined by a pair of upright walls 40M1 that extends downwardly from the second outer surface 40N to a base wall 40M2 that is defined below the second outer surface 40N. Each cavity of the set of cavities 40M is also defined by a connecting wall 40M3 that connects the walls of the pair of upright walls 40M1 with one another and extends downwardly from the second outer surface 40N to the base wall 40M2. In the present disclosure, the walls of the pair of upright walls 40M1 are arranged at an acute angle relative to the connecting wall 40M3 where the corresponding cavity of the set of cavities 40M defines a truncated V-shaped configuration; such use and purpose of the truncated V-shaped configuration is discussed in greater detail below. In other exemplary embodiments, walls of the pair of upright walls 40M1 may be arranged at any suitable angle relative to the connecting wall 40M3 to define a desired shape for a cavity of the set of cavities 40M. In the present disclosure, each base wall 40M2 also defines a truncated V-shaped based on the arrangement of the pair of upright walls 40M1 and the connecting wall 40M3 when viewed from a side perspective (see FIG. 4B); such use and purpose of the truncated V-shaped is discussed in greater detail below. In other exemplary embodiments, each base wall 40M2 may define any suitable shape dictated by the implantation and/or use of the base walls 40M2 as well as the arrangement of the pair of upright walls 40M1 and the connecting wall 40M3.

Housing 40 also defines a set of through-holes 40P in the base walls 40M2. As best seen in FIGS. 4B and 9, each through-hole of the set of through-holes 40P extends vertically through each base wall 40M2 such that the passageway 40F and the set of cavities 40M are in communication with one another at the set of through-holes 40P. Such use and purpose of the set of through-holes 40P is discussed in greater detail below.

Housing 40 also includes a first shoulder 40Q. As best seen in FIGS. 4B and 9, first shoulder 40Q extends radially outward from the second outer surface 40N to third exterior surface 40R, which is discussed in greater detail below. The first shoulder 40Q is also positioned rearward of and/or behind the set of cavities 40M. In the present disclosure, the first shoulder 40Q defines a diameter that is greater than diameters defined along the first outer surface 40H and the second outer surface 40N.

Referring to third exterior surface 40R, the third exterior surface 40R extends from the first shoulder 40Q to a second shoulder or stop 40S that is positioned longitudinally opposite to the first shoulder 40Q. In the present disclosure, the stop 40S defines a diameter that is greater than the diameter defined by the first shoulder 40Q for stopping means, which is discussed in greater detail below. Housing 40 may also define a set of grooves 40T that extends into the cylindrical wall 40D from the third exterior surface 40R towards the interior surface 40E (see FIGS. 4B and 8-9). Each groove of the set of grooves 40T also spans longitudinally from a front end 40T1 to the stop 40S. In the present disclosure, four grooves 40T are defined in the housing 40 and extends into the cylindrical wall 40D from the third exterior surface 40R towards the interior surface 40E and spans longitudinally from front ends 40T1 to the stop 40S. In other exemplary embodiments, any suitable number of grooves may be defined in housing 40 as dictated by the implementation and/or use of the grooves.

Housing 40 also defines a fourth exterior surface 40U. As best seen in FIG. 2, fourth exterior surface 40U extends from the stop 40S to the rear end 40B of the housing 40. In the present disclosure, the diameters defined by the stop 40S and defined by the housing 40 along the fourth exterior surface 40U are equal to one another.

Figure 3:
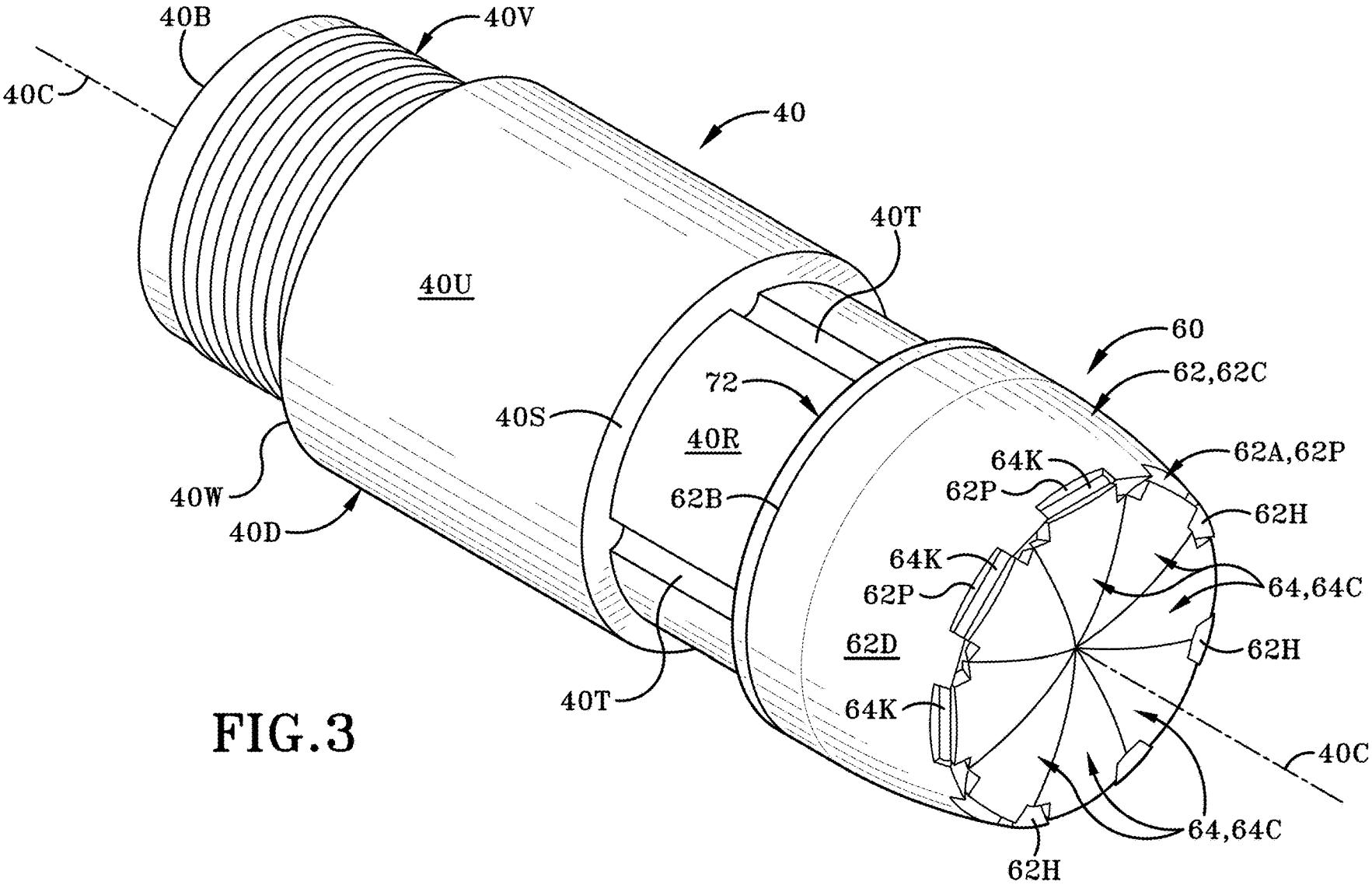
FIG. 3 is a front, top, first side isometric perspective view of the housing and the cover, wherein the cover is provided in the pre-flight configuration.

Housing 40 also defines an external threading 40V. As best seen in FIGS. 2-3, the external threading 40V extends from the rear end 40B to a third shoulder 40W of the housing 40 that is positioned behind the stop 40S. In the present disclosure, the external threading 40V and the internal threading 22E of the body 22 are complementary to one another in order to threadably engage the body 22 and the housing 40 with one another.

Based on the structural configuration of housing 40, housing 40 may be divided into one or more sections. In the present disclosure, housing 40 may include a first section that extends from the front end 40A to the first shoulder 40Q, a second section that extends from the first shoulder 40Q and the stop 40S, and a third section that extends from the stop 40S to the rear end 40B. In the present disclosure, the second section is positioned rearward of or behind the first section, and the third section is positioned rearward of or behind the first section and the second section. In the present disclosure, the second section also defines a diameter that is greater than a diameter defined by the first section, and the third section defines a diameter that is greater than diameters defined by the first section and the second section.

Projectile 1 also includes a nose-mounted imaging device or second guidance apparatus 50. As best seen in FIG. 8, imaging device 50 operably engages with the cylindrical wall 40D of the housing 40 and is housed inside of the housing 40. Particularly, imaging device 50 operably engages with the interior surface 40E of the cylindrical wall 40D inside of the passageway 40F. Imaging device 50 also includes a viewing window 50A that extends through the front end 40A of the housing 40 such that the viewing window 50A is the foremost component of projectile 1 during flight, which is discussed in greater detail below. In operation, the imaging device 50 is configured to search and detect an aerial target at a desired viewing angle when the projectile 1 is in flight by measuring various light wavelengths emitted by an aerial targets, including, but not limited to, infrared wavelengths, visible light wavelengths, and ultraviolet wavelengths. In the present disclosure, the imaging device 50 is configured to search and detect aircrafts and air vehicles (manned or unmanned) when the projectile 1 is in flight by measuring various light wavelengths emitted by an aerial targets.

It should be understood that imaging device 50 may also include available hardware and protocols that are configured to initiate and/or deploy on-board devices to guide and/or direct the projectile 1 to a specific target. In the present disclosure, the imaging device 50 is also configured to operatively communicate with the first guidance apparatus 20 to enable guidance capabilities to the projectile 1. When the projectile 1 is in flight, the set of optical imaging device 26 of the first guidance apparatus 20 and the imaging device 50 may operate together to guide the projectile to a desired target or point of interest.

Figure 12:
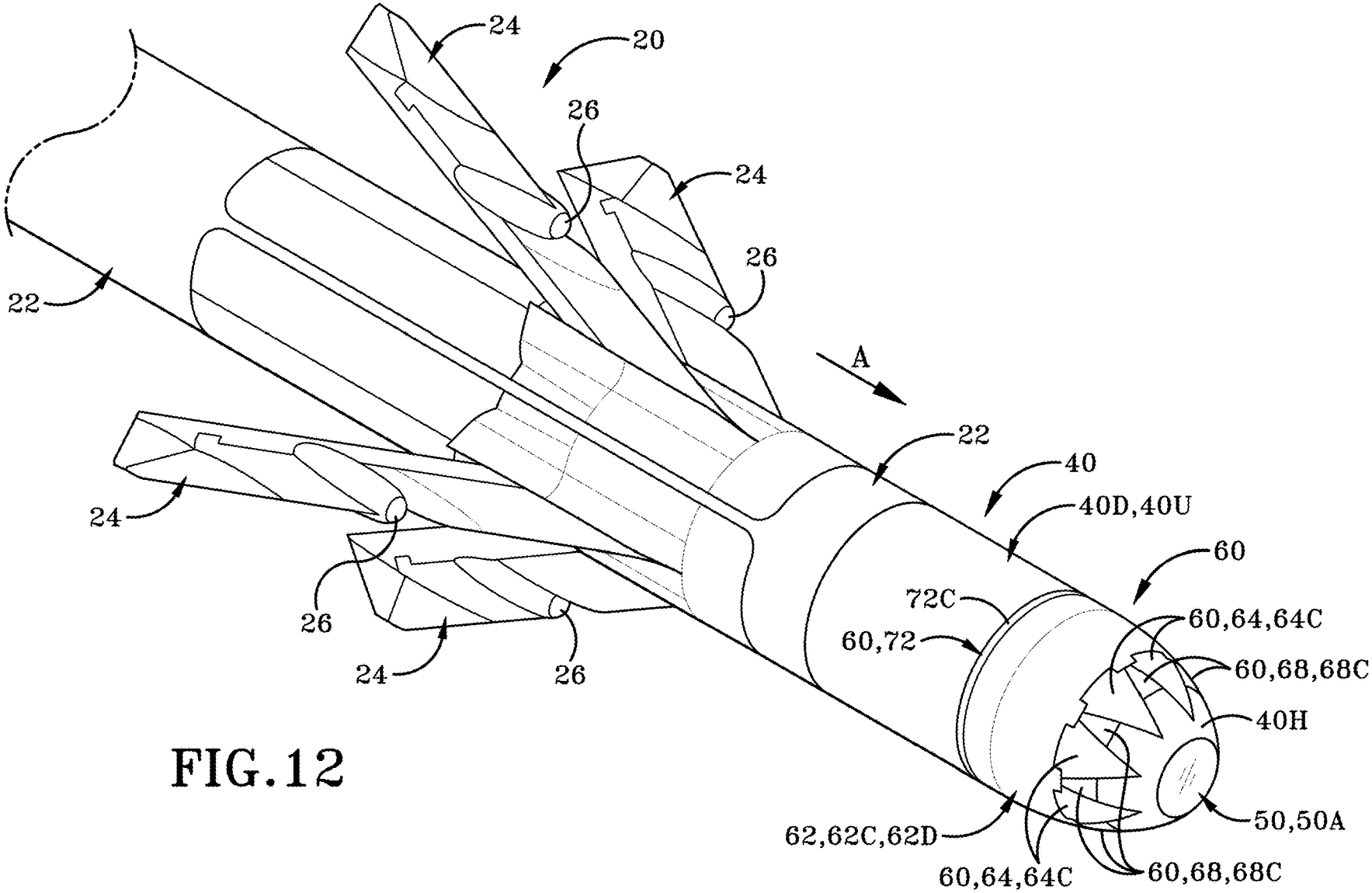
FIG. 12 is a partial front, top, first side isometric perspective view of the projectile, wherein the cover is provided in the flight configuration and the viewing window of the imaging device is exposed to the external environment.

Projectile 1 may also include a cover 60 that operably engages with the housing 40. In the present disclosure, cover 60 is configured to be moveable along the longitudinal axis 40C of the housing 40 between a pre-flight or covered configuration (see FIGS. 1-2) and a flight/in-flight or uncovered configuration (see FIG. 12). In the covered configuration, the cover 60 is configured to completely cover and/or shield the viewing window 50A of the imaging device 50 from the external environment surrounding the projectile 1 prior to being launched from a platform. In the uncovered configuration, the cover 60 has linearly moved along the longitudinal axis 40C of the housing 40 towards the rear end 40B and away from the viewing window 50A based on an initial impulse or launch acceleration generated by the rocket motor 10. In the uncovered configuration, cover 60 is spaced apart from the viewing window 50A so that the imaging device 50 may search and detect for an aerial target when in flight. Such components of the cover 60 are discussed in greater detail below.

Cover 60 includes a sleeve 62. As best seen in FIG. 4A, sleeve 62 includes a first or front end 62A, a second or rear end 62B longitudinally opposite to the front end 62A, and a wall 62C that extends longitudinally between the front end 62A and the rear end 62B. Sleeve 62 also includes an exterior surface 62D that extends continuously along the wall 62C between the front end 62A and the rear end 62B and faces outwardly from the sleeve 62. Sleeve 62 also includes an interior surface 62E that extends continuously along the wall 62C between the front end 62A and the rear end 62B and faces into the sleeve 62 in an opposite direction relative to the exterior surface 62D (see FIGS. 8-9). Sleeve 62 also defines a passageway 62F that extends longitudinally inside of wall 62C between the front end 62A and the rear end 62B. As best seen in FIGS. 8-9, the passageway 62F is accessible at the front end 62A and the rear end 62B due to the front end 62A and the rear end 62B being open ends.

Still referring to sleeve 62, sleeve 62 also includes a projection 62G. As best seen in FIGS. 4A and 8, the projection 62G is positioned at the front end 62A of the sleeve 62 inside of the passageway 62F. Particularly, the projection 62G extends radially into the passageway 62F from the interior surface 62E such that the projection 62G decreases an inner diameter of the passageway 62F at the front end 62A of the sleeve 62.

Still referring to sleeve 62, sleeve 62 also includes a set of extensions 62H. As best seen in FIGS. 4A and 9, each extension of the set of extensions 62H is formed with the projection 62G and extends longitudinally forward from the front end 62A while also extending transversely into the passageway 62F. Each extension of the set of extensions 62H includes an outer end 62H1 that is even with the exterior surface 62D of the sleeve 62, an inner end 62H2 that is opposite to the outer end 62H1, positioned in front of or ahead of the passageway 62F, and defines a triangular-shaped notch, and a pair of lateral walls 62H3 extending between the outer end 62H1 and the inner end 62H2. Each extension of the set of extensions 62H is also spaced apart from one another and define a series recesses 62P along the length of the projection 62G; such spaced apart configuration of the set of extensions 62H is discussed in greater detail below.

Still referring to sleeve 62, sleeve 62 also defines a set of grooves 62K. As best seen in FIG. 4A, each groove of the set of grooves 62K extends into the projection 62G from the front end 62A and towards the rear end 62B. Each groove of the set of grooves 62K is also defined between two adjacent extensions of the set of extensions 62H. Each groove of the set of grooves 62K is also aligned with a passage 62L defined in each extension of the set of extensions 62H having a pivot axis 62N that extends therethrough for indicating pivoting means of the cover 60 (see FIG. 4A), which are discussed in greater detail below.

Still referring to sleeve 62, sleeve 62 also defines a set of attachment holes 62M. As best seen in FIG. 8, each attachment hole of the set of attachment holes 62M is defined at the rear end 62B of the sleeve 62 and extends longitudinally into the wall 62C from the rear end 62B towards the front end 62A. Such use and purpose of the set of attachment holes 62M is discussed in greater detail below.

Figure 5:
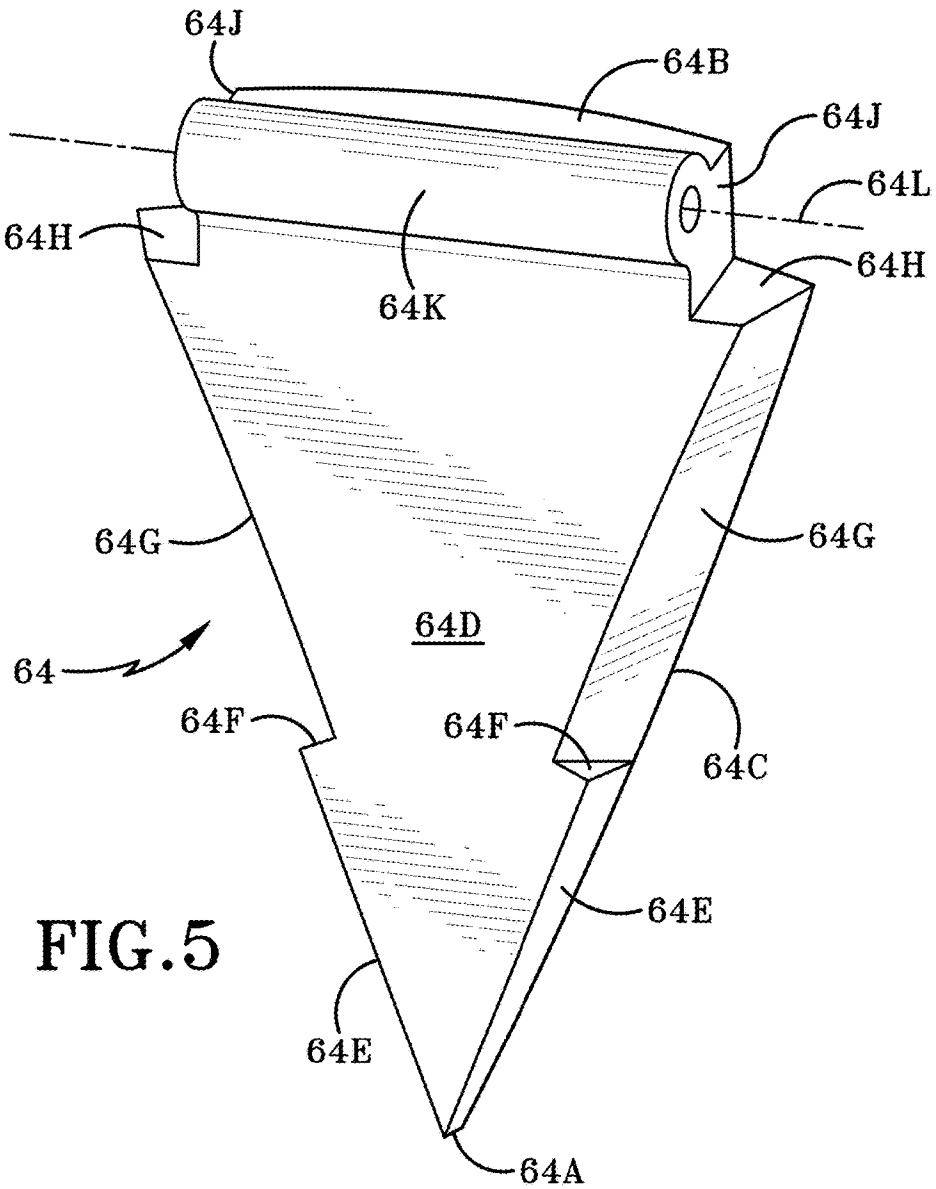
FIG. 5 is a rear, top, first side isometric perspective view of a flap from the set of first flaps of the cover.

Cover 60 also includes a set of first flaps 64 that operably engages with the sleeve 62. As best seen in FIG. 5, each flap of the set of first flaps 64 includes a tip or first end 64A, a base or second end 64B opposite to the tip 64A, an outer surface 64C that extends between the tip 64A and the base 64B and faces in a first direction, and an inner surface 64D that extends between the tip 64A and the base 64B and faces in a second direction opposite to the first direction.

Still referring to the set of first flaps 64, each flap of the set of first flaps 64 includes a pair of first side walls 64E that extends rearward from the tip 64A to a pair of first shoulders 64F (see FIG. 5). It should be understood that each side wall of the pair of first side walls 64E mirrors one another, and each shoulder of the pair of first shoulders 64F mirrors one another. Each flap of the set of first flaps 64 further includes a pair of second side walls 64G that extends rearward from the pair of first shoulders 64F to a pair of second shoulders 64H (see FIG. 5). It should be understood that each side wall of the pair of second side walls 64G mirrors one another, and each shoulder of the pair of second shoulders 64H mirrors one another. Each flap of the set of first flaps 64 also includes a pair of third side walls 64J that extends rearward from the set of second shoulders 64H to the base 64B (see FIG. 5). It should be understood that each side wall of the pair of third side walls 64J mirrors one another.

Each flap of the set of first flaps 64 also includes a tubular member or barrel 64K that is formed at the base 64B and extends transversely between the pair of third side walls 64J; such use and purpose of the tubular member 64K is discussed in greater detail below. As best seen in FIGS. 4A and 5, a pivot axis 64L extends entirely through the tubular member 64K of each flap of the set of first flaps 64. Upon assembly of cover 60, the pivot axis 64L of each flap of the set of first flaps 64 is coaxial with the pivot axis 62N of each passages 62L defined in the sleeve 62.

In the present disclosure, the outer surface 64C and the inner surface 64D of each flap of the set of first flaps 64 may define any suitable shape and/or configuration based on various considerations, including the structural arrangement with the housing 40 and the sleeve 62 when provided in the covered configuration and the uncovered configuration. In one example, the outer surface 64C of each flap of the set of first flaps 64 defines a concave shape that extends transversely between the pair of first side walls 64E, the pair of first shoulders 64F, the pair of second side walls 64G, the pair of second shoulders 64H, and the pair of third side walls 64J to match with the outer profile of the housing 40 when the cover 60 is provided in the uncovered configuration, which is discussed in greater detail below. In this same example, the inner surface 64D of each flap of the set of first flaps 64 defines a planar and/or linear shape that extends longitudinally between the tip 64A and the base 64B to match the profile of the base walls 40G2 of the set of cutouts 40G of the housing 40 when the cover 60 is provided in the uncovered configuration, which is discussed in greater detail below.

Figure 7:
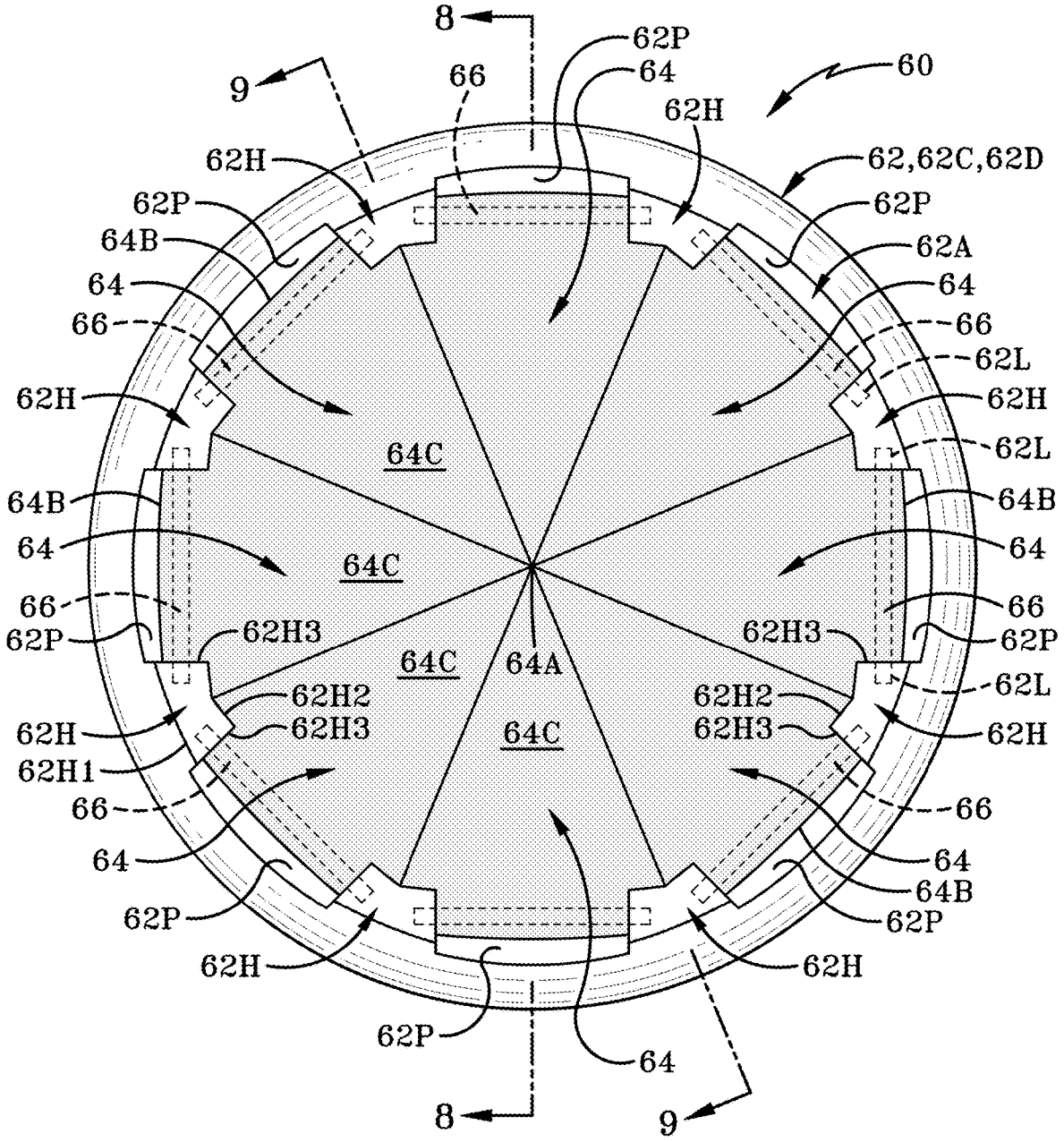
FIG. 7 is a front elevation view of the projectile.

Cover 60 also includes a plurality of first braces or first pivot pins 66. As best seen in FIG. 7, each pivot pin of the plurality of first pivot pins 66 is configured to pivotably engage the set of first flaps 64 with the sleeve 62. Upon assembly, the plurality of first pivot pins 66 passes through and operably engages with the tubular members 64K of the set of first flaps 64. Upon such engagement, each flap of the set of first flaps 64 is pivotable and/or rotatable about a longitudinal or pivot axis of each pivot pin of the plurality of first pivot pins 66; such pivoting and/or rotation of the set of first flaps 64 is discussed in greater detail below. Upon assembly, the plurality of first pivot pins 66 also passes through the passages 62L defined in the set of extensions 62H to operably engage with the sleeve 62. Upon engagement with the sleeve 62, the plurality of first pivot pins 66 is also received and housed inside of the set of grooves 62K to operably engage with the sleeve 62.

While the present disclosure describes and illustrates a plurality of first pivot pins 66 being operably engaged with the housing 40, the sleeve 62, and the set of first flaps 64, a first pivot pin of a cover discussed herein may have any suitable structural configuration that enables each flap of a set of first flaps to pivot and/or rotate about the first pivot pin relative to a sleeve of the cover. In one example, a single, monolithic pivot pin of a cover may operably engage with a housing, a sleeve of the cover, and a set of first flaps to enable the set of first flaps to pivot and/or rotate relative to the sleeve of the cover.

Figure 8A:
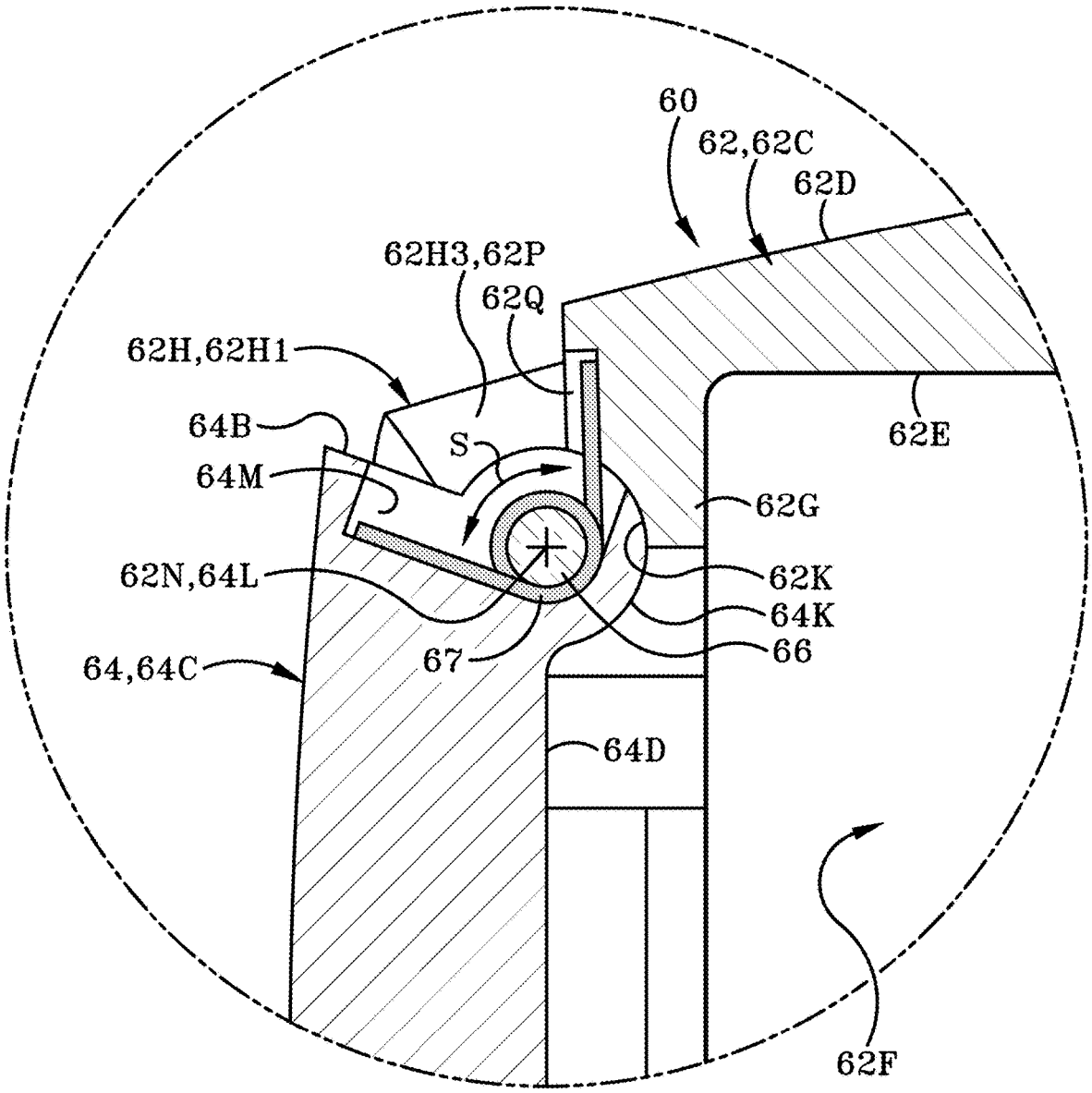
FIG. 8A is an alternative embodiment of the projectile, wherein the cover includes a set of first biasers.

In an alternative embodiment, at least one or more biasers may be operably engaged with the sleeve 62, the set of first flaps 64, and a plurality of first pivot pins 66 to bias the set of first flaps 64 to the covered configuration (see FIG. 2). As best seen in FIG. 8A, a biaser of a set of first biasers 67 may operably engage with the sleeve 62, a respective flap of the set of first flaps 64, and a respective pivot pin of the plurality of first pivot pins 66 to bias the set of first flaps 64 to the covered configuration. In this example, each biaser of the set of first biasers 67 operably engages with a respective pivot pin of the plurality of first pivot pins 66 such that the biaser 67 is wrapped about and/or around the longitudinal axis of said pivot pin. In this same example, each biaser of the set of first biasers 67 also operably engages with the sleeve 62 inside of a respective cavity of a set of cavities 62Q defined at the front end 62A of the sleeve 62 and with a respective flap of the set of first flaps 64 inside a base cavity 64M defined in the respective flap. With such configuration, the set of first biasers 67 applies an outward biasing force on the sleeve 62 and on the set of first flaps 64; such biasing force applied by each biaser of the set of first biasers 67 is denoted by a double arrow labeled "S" in FIG. 8A. Such biasing performed by the set of first biasers 67 may prevent inadvertent movement of the cover 60 from the covered configuration to the uncovered configuration when the projectile 1 is loaded onto a platform or when the projectile 1 traveling with the platform in flight.

It should be understood that any suitable biaser or biasing device may be operably engaged with the sleeve 62, each flap of the set of first flaps 64, and each pivot pin of the plurality of first pivot pins 66 to bias the set of first flaps 64 to the covered configuration. In one example, and as best seen in FIG. 8A, a set of torsion springs operably engage with the sleeve 62, the set of first flaps 64, and the plurality of first pivot pins 66 to bias the set of first flaps 64 to the covered configuration; such configuration of these torsions springs with the sleeve 62, the set of first flaps 64, and the plurality of first pivot pins 66 is discussed above.

Figure 6:
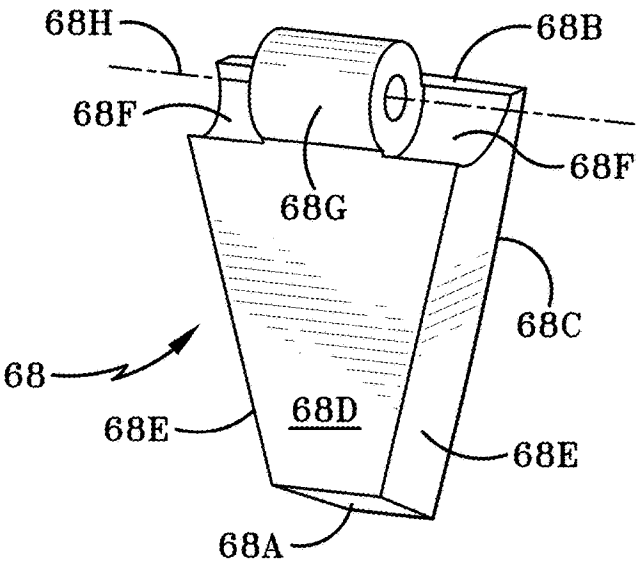
FIG. 6 is a rear, top, first side isometric perspective view of a flap from the set of second flaps of the cover.

Cover 60 also includes a set of second flaps 68 that operably engages with the housing 40 and the sleeve 62. As best seen in FIG. 6, each flap of the set of second flaps 68 includes a tip or first end 68A, a base or second end 68B opposite to the tip 68A, an outer surface 68C that extends between the tip 68A and the base 68B and faces in a first direction, and an inner surface 68D that extends between the tip 68A and the base 68B and faces in a second direction opposite to the first direction.

Still referring to the set of second flaps 68, each flap of the set of second flaps 68 includes a pair of side walls 68E that extends rearward from the tip 64A to a pair of arcuate walls 68F (see FIG. 6). It should be understood that each side wall of the pair of side walls 68E mirrors one another, and each arcuate wall of the pair of arcuate walls 68F mirrors one another.

Each flap of the set of second flaps 68 also includes a tubular member or barrel 68G that is formed at the base 68B and extends transversely between the pair of actuate walls 68F; such use and purpose of the tubular member 68G is discussed in greater detail below. As best seen in FIGS. 4B and 6, a pivot axis 68H extends entirely through the tubular member 68G of each flap of the set of second flaps 68. Upon assembly of cover 60, the pivot axis 68H of each flap of the set of second flaps 68 is coaxial with the pivot axis 40L1 of each opening 40L defined in the extensions 40K of housing 40.

In the present disclosure, the tip 68A and the outer surface 68C of each flap of the set of second flaps 68 may define any suitable shape and/or configuration based on various considerations, including the structural arrangement with the housing 40 and the sleeve 62 when provided in the covered configuration and the uncovered configuration. In one example, the tip 68A of each flap of the set of second flaps 68 defines a planar and/or linear shape that tapers downwardly from the outer surface 68C to the inner surface 68D to match of a corresponding cavity of the set of cavities 40M when the cover 60 is provided in the covered configuration, which is discussed in greater detail below. In this same example, the outer surface 68C of each flap of the set of second flaps 68 defines a concave shape that extends transversely between the pair of side walls 68E and the pair of arcuate walls 68F to match with the outer profile of the housing 40 and the set of first flaps 64 when the cover 60 is provided in the uncovered configuration, which is discussed in greater detail below.

Cover 60 also includes a plurality of second braces or pivot pins 70. As best seen in FIG. 9, the plurality of second pivot pins 70 is configured to pivotably engage the set of second flaps 68 with the housing 40. Upon assembly, the plurality of second pivot pins 70 passes through and operably engages with the tubular members 68G of the set of second flaps 68. Upon such engagement, each flap of the set of second flaps 68 is pivotable and/or rotatable about a longitudinal or pivot axis 70A of a pivot pin of the plurality of second pivot pins 70; such pivoting and/or rotation of the set of second flaps 68 is discussed in greater detail below. Upon assembly, the plurality of second pivot pins 70 also passes through openings 40L defined in the pairs of extensions 40K of the housing 40 to operably engage with the housing 40.

Figure 9A:
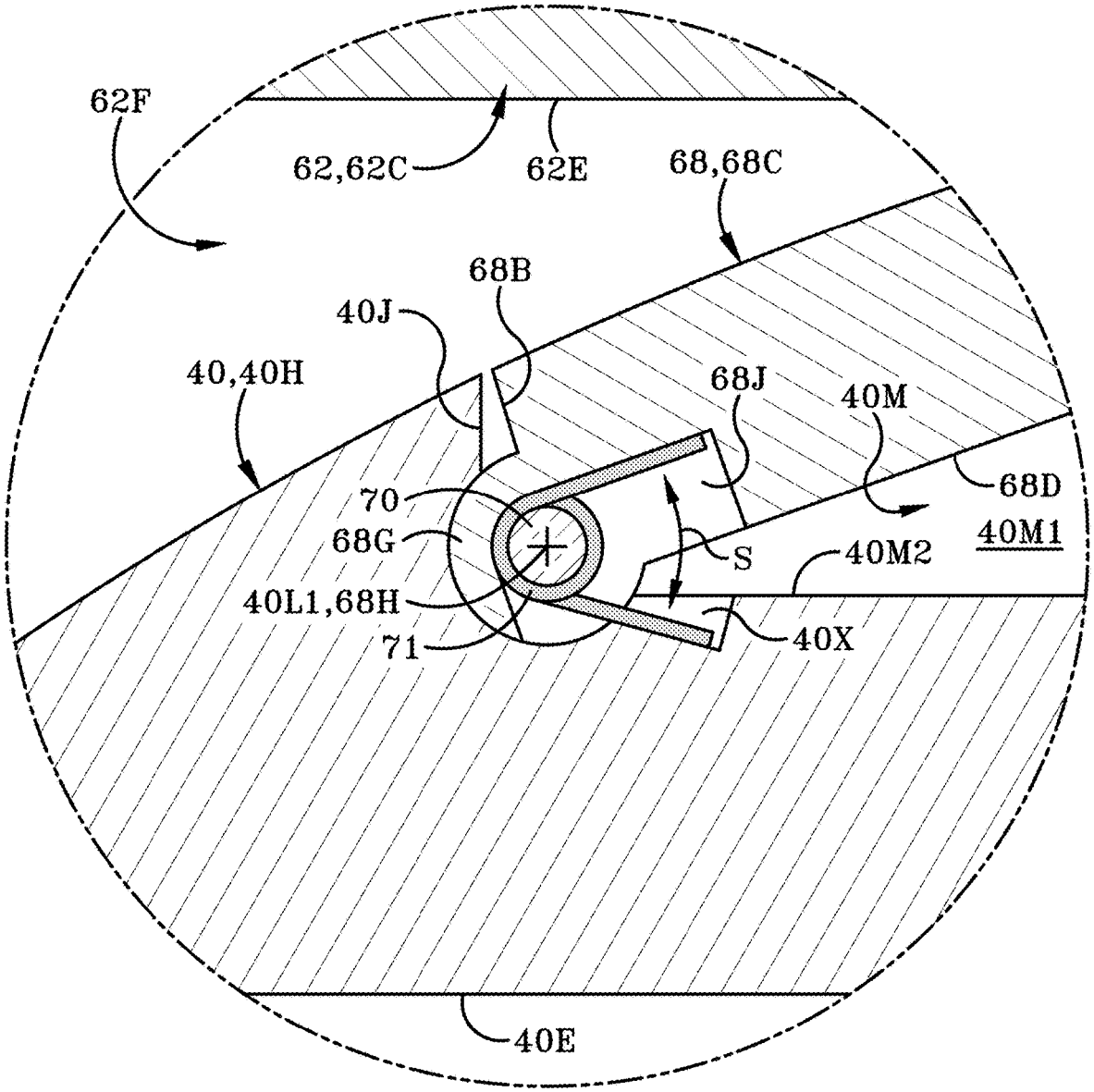
FIG. 9A is an alternative embodiment of the projectile, wherein the cover includes a set of second biasers.
Figure 10B:
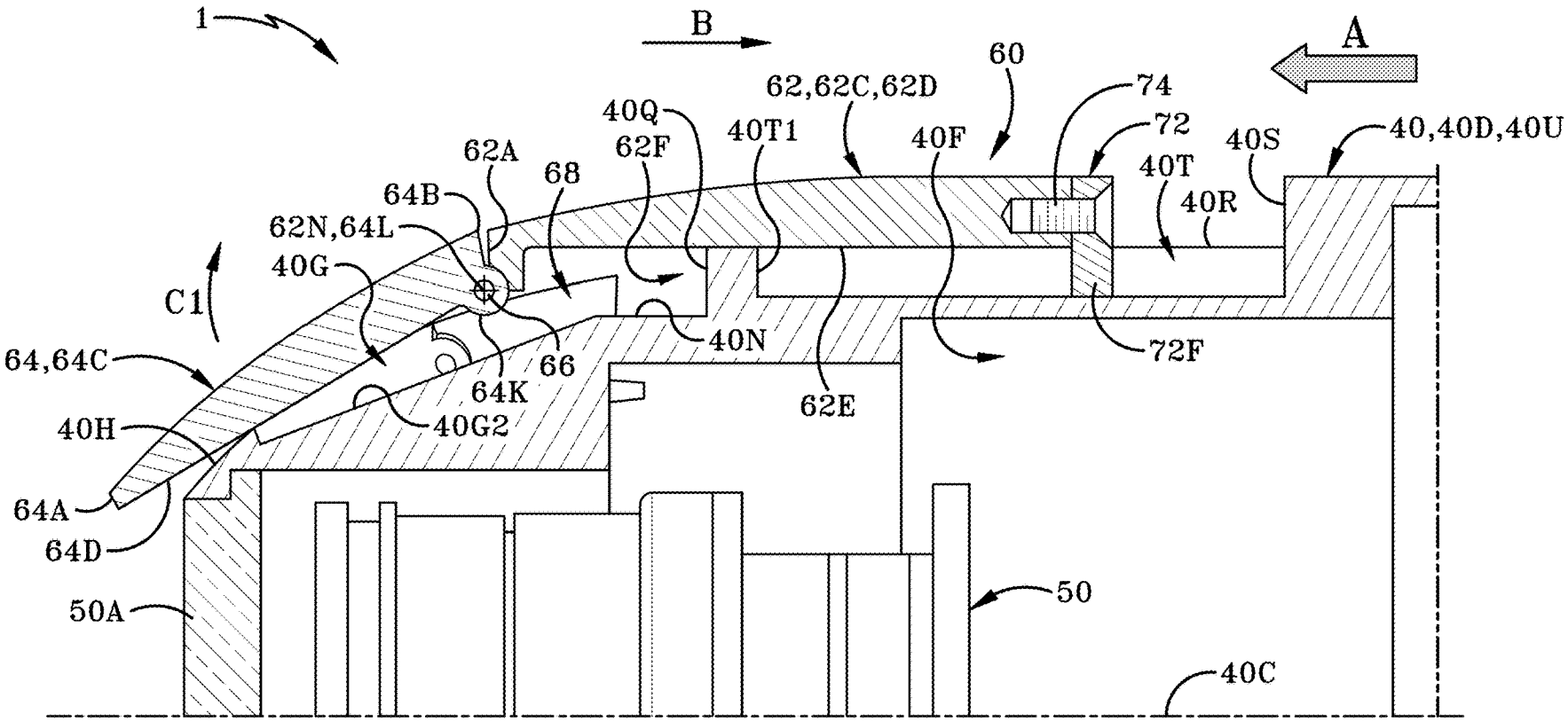
FIG. 10B is another operational view similar to FIG. 10A, but the set of first flaps is rotated from the pre-flight configuration towards the flight configuration to expose a viewing window of the imaging device.
Figure 10C:
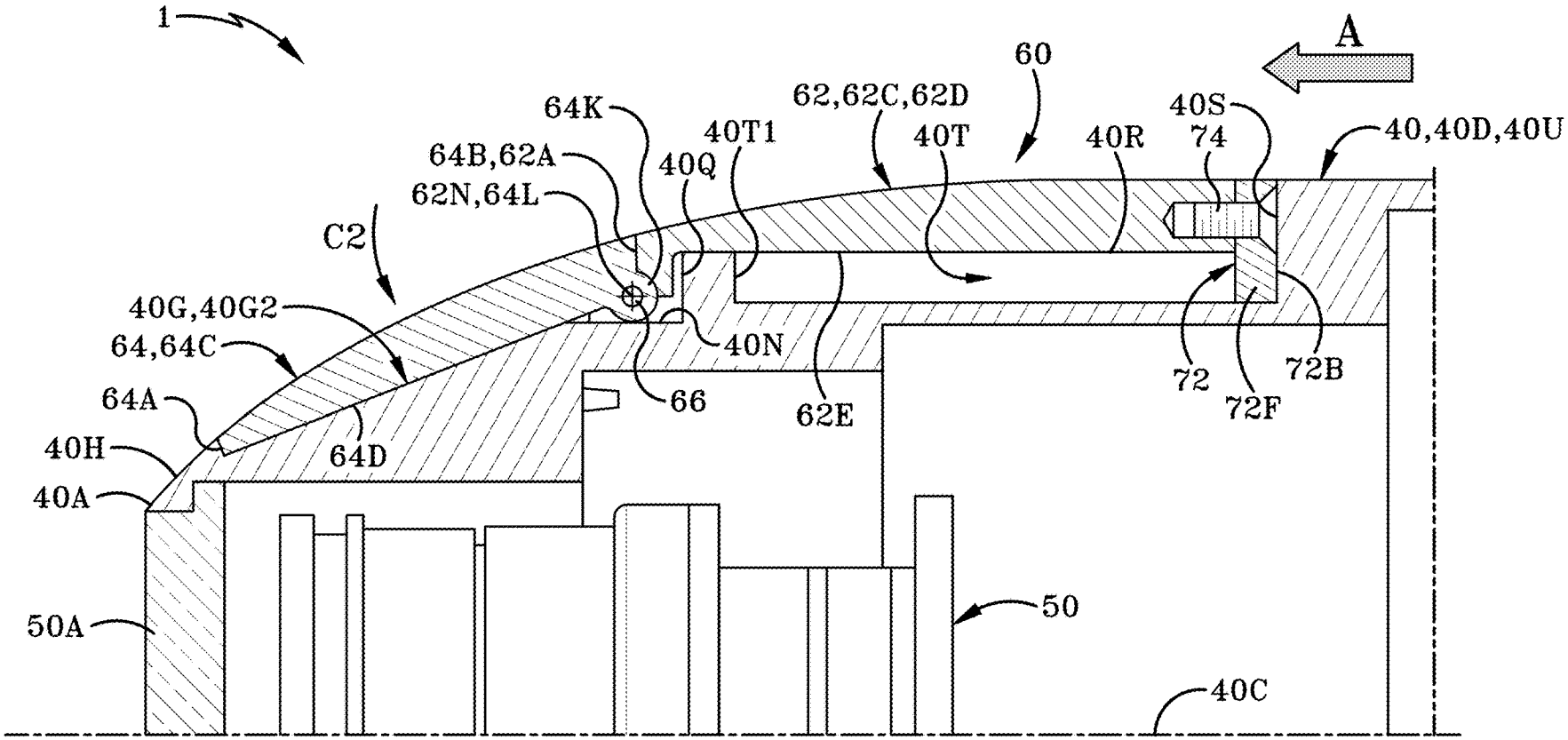
FIG. 10C is another operational view similar to FIG. 10B, but the sleeve is stopped by the housing and the set of first flaps is provided in the flight configuration to form a continuous outer surface along the housing, the sleeve, the set of first flaps, and the pair of guide brackets.
Figure 10D:
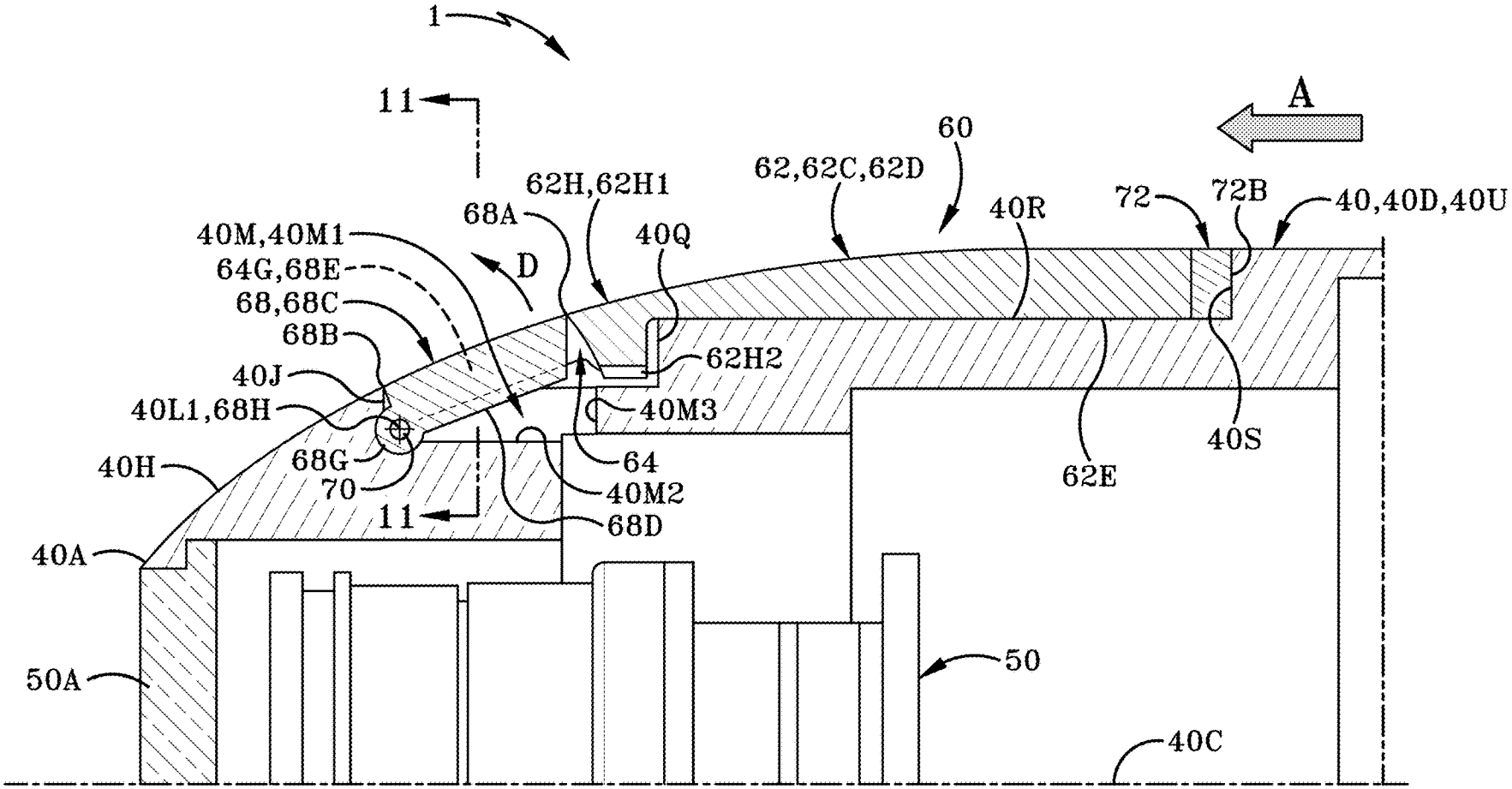
FIG. 10D is another operational view similar to FIG. 10C, but the set of second flaps is rotated from the pre-flight configuration to the flight configuration to form the continuous outer surface along the housing, the sleeve, the set of first flaps, the set of second flaps, and the pair of guide brackets.

In another alternative embodiment, at least one or more biasers may be operably engaged with the housing 40, the set of second flaps 68, and the plurality of second pivot pins 70 to bias the set of second flaps 68 to the uncovered configuration when the sleeve 62 is moved away from the set of second flaps 68 (see FIG. 10D). As best seen in FIG. 9A, each biaser of a set of second biasers 71 operably engages with the housing 40, each flap of the set of second flaps 68, and each pivot pin of the plurality of second pivot pins 70 to bias the set of second flaps 68 to the uncovered configuration when the sleeve 62 is moved away from the set of second flaps 68. In this example, each biaser of the set of second biasers 71 operably engages with a respective pivot pin of the plurality of second pivot pins 70 such that the biaser 71 is wrapped about and/or around the longitudinal axis of said pivot pin. In this same example, each biaser of the set of second biasers 71 also operably engages with the housing 40 inside of a respective depression of a set of depressions 40X defined in a respective base wall 40M2 and with a respective flap of the set of second flaps 68 inside a base cavity 68J defined in the respective flap. With such configuration, each biaser of the set of second biasers 71 applies an outward biasing force on the housing 40 and on each flap of the set of second flaps 68; such biasing force applied by each biaser of the set of second biasers 71 is denoted by a double arrow labeled "S" in FIG. 9A. Such biasing may prevent inadvertent movement of the cover 60 from the covered configuration to the uncovered configuration when the projectile 1 is loaded onto a platform or when the projectile 1 traveling with the platform in flight.

It should be understood that any suitable biasers or biasing devices may be operably engaged with the housing 40, the set of second flaps 68, and the plurality of second pivot pins 70 to bias the set of second flaps 68 to the uncovered configuration when the sleeve 62 is moved away from the set of second flaps 68. In one example, and as best seen in FIG. 9A, a set of torsion springs operably engage with the housing 40, the set of second flaps 68, and the plurality of second pivot pins 70 to bias the set of second flaps 68 to the uncovered configuration; such configuration of these torsions springs with the housing 40, the set of second flaps 68, and the plurality of second pivot pins 70 is discussed above.

Cover 60 also includes a pair of guide brackets 72. As best seen in FIG. 4A, each guide bracket of the pair of guide brackets 72 includes a front end 72A, a rear end 72B opposite to the first end 72A, an outer circumferential surface 72C that extends between the front end 72A and the rear end 72B and is positioned above the front end 72A and the rear end 72B, and an inner circumferential surface 72D that extends between the front end 72A and the rear end 72B and is positioned below the front end 72A and the rear end 72B.

The pair of guide brackets 72 also defines a central opening 72E inside of the inner circumferential surfaces 72D between the front ends 72A and the rear ends 72B. In the present disclosure, central opening 72E is configured to receive and house a portion of the housing 40 wherein the inner circumferential surfaces 72D of the pair of guide brackets engages with the third exterior surface 40R of the housing 40 when the cover 60 is assembled with the housing 40.

Still referring to the pair of guide brackets 72, each guide bracket of the pair of guide brackets 72 also includes a set of guide prongs 72F. As best seen in FIG. 4A, each guide prong of the set of guide prongs 72F extends outwardly from inner circumferential surface 72D. Upon assembly, the set of guide prongs 72F operably engages with the housing 40 inside of the set of grooves 40T to guide the cover 60 along the longitudinal axis 40C of the housing 40 when the cover 60 transitions from the covered configuration to the uncovered configuration.

Still referring to the pair of guide brackets 72, each guide bracket of the pair of guide bracket 72 also includes a set of attachment apertures 72G. As best seen in FIGS. 8-9, each attachment aperture of the set of attachment apertures 72G extends entirely through the guide bracket 72 such that the front end 72A and the rear end 72B are in operative communication with one another at each attachment aperture of the set of attachment apertures 72G. Upon assembly of the cover 60, the set of attachment apertures 72G is coaxial with the set of attachment holes 62M of sleeve 62 such that a set of fasteners 74 attaches the sleeve 62 and the guide bracket 72 with one another. Such attachment between the sleeve 62 and the guide bracket 72 enables the guide bracket 72 to guide or lead the sleeve 62 along the longitudinal axis 40C of the housing 40 when the cover 60 transitions between the covered configuration and the uncovered configuration.

While the sleeve 62 and the guide bracket 72 are described and illustrated as separate components, the components of the guide bracket 72 may be integral with the sleeve 62 to reduce the overall footprint of the cover 60. In one instance, the set of guide prongs 72F may be formed on the rear end 62B of the sleeve 62 to reduce the overall footprint of the sleeve and the guide bracket 72. It should also be understood that while a single guide bracket 72 is described and illustrate herein, any suitable number of guide brackets may be used to guide and/or lead the sleeve 62 along the longitudinal axis 40C of the housing 40.

As discussed above, the cover 60 is configured to transition between a covered configuration (FIGS. 8-9) prior to the projectile 1 being launched from a platform and a uncovered configuration (see FIGS. 10C-10D and 12) subsequent to the cover 60 experiencing an initial impulse or launch acceleration generated by the rocket motor 10 after being launched from the platform. Such structural arrangement of the cover 60 relative to the housing 40 and the imaging device 50 in both the covered configuration and the uncovered configuration is discussed in greater detail below.

In the covered configuration, the cover 60 completely protects the front end 40A of the housing 40 (as well as the first section and a portion of the second section of the housing 40) and the viewing window 50A of the imaging device 50 from the external environment surrounding the projectile 1, including soot and other debris that may be exhausted from a rocket motor of an adjacent projectile upon being launched from the platform. In this configuration, the sleeve 62, particularly the set of extensions 62H, is positioned ahead of the viewing window 50A (see FIG. 8).

Still referring to the covered configuration, the set of first flaps 64 is also positioned ahead of the viewing window 50A wherein the set of first flaps 64 creates a barrier or seal ahead of the viewing window 50A to prevent unwanted debris or soot from interacting with the viewing window 50A (see FIG. 8). The set of first flaps 64 may also be maintained at the covered configuration due to the biasing force applied to the set of first flaps 64 by the set of first biasers 67 engaged with at least the sleeve 62, the set of first flaps 64, and the plurality of first pivot pins 66.

Still referring to the covered configuration, the set of second flaps 68 is also positioned inside of the passageway 62F of the sleeve 62. The set of second flaps 68 may also be maintained at the covered configuration due to the interior surface 62E of the sleeve 62 engaging with the outer surfaces 68C of the set of second flaps 68 even through a biasing force may be applied to the set of second flaps 68 by the set of second biasers 71 engaged with the set of second flaps 68 and the plurality of second pivot pins 70.

Still referring to the covered configuration, the sleeve 62 and the guide bracket 72 may also be spaced apart from the stop 40S. In particular, the rear end 62B of the sleeve 62 is remote from the stop 40S and is positioned near the first shoulder 40Q. Similarly, rear end 70B of the guide bracket 72 is also spaced apart from the stop 40S and is positioned near the first shoulder 40Q.

In the uncovered configuration, the cover 60 is completely removed from the front end 40A of the housing 40 and the viewing window 50A of the imaging device 50 so that the imaging device 50 may view the external environment forward of the projectile 1. The cover 60 transitions from the covered configuration to the uncovered configuration upon receiving an initial impulse or launch acceleration generated by the rocket motor 10 when the projectile 1 is launched.

In this configuration, the sleeve 62, particularly the set of extensions 62H, is positioned behind and remote from the viewing window 50A due to the sleeve 62 slidably moving in a rearward direction along the housing 40 towards the rear end 40B (see FIGS. 10A-10C). In this configuration, the set of first flaps 64 is also positioned behind and remote from the viewing window 50A so that the imaging device 50 may view the external environment forward of the projectile 1. If biasers are operably engaged with the sleeve 62, the set of first flaps 64, and the plurality of first pivot pins 66, the impulse generated by the rocket motor 10 after launching the projectile 1 is greater than the biasing force applied by these biasers thus causing the set of first flaps 64 to pivot outwardly away from one another and to ride along the first outer surface 40H of housing 40. The set of first flaps 64 continues to ride along the first outer surface 40H of housing 40 until the set of first flaps 64 are seated in the set of cutouts 40G of the housing 40. In the uncovered configuration, the outer surfaces 64C of the set of first flaps 64 are also even with and/or continuous with the first outer surface 40H of the housing 40. Such arrangement of the housing 40 and the set of first flaps 64 in the uncovered configuration provides a continuous surface along the front portion of the projectile 1 to maintain suitable aerodynamics of the projectile 1 once the projectile 1 is in flight.

Still referring to the uncovered configuration, the set of second flaps 68 is also positioned outside of the passageway 62F of the sleeve 62 due to the sleeve 62 being positioned behind the set of second flaps 68. If biasers are operably engaged with the housing 40, the set of second flaps 68, and the plurality of second pivot pins 70, the biasers will apply a biasing force against each flap of the set of second flaps 68 once the opposing downward force applied by the sleeve 62 is removed from the set of second flaps 68. In the uncovered configuration, the set of second flaps 68 is positioned between the set of first flaps 64 such that each flap of the set of second flaps 68 is nested between two adjacent flaps of the set of first flaps 64. In this configuration, the outer surfaces 64D of the set of second flaps 68 are even with and/or continuous with the outer surfaces 64C of the set of first flaps 64 and the first outer surface 40H of the housing 40. Such arrangement of the housing 40, the set of first flaps 64, and the set of second flaps 68 in the uncovered configuration provides a continuous surface along the front portion of the projectile 1 to maintain suitable aerodynamics of the projectile 1 once the projectile 1 is in flight.

Still referring to the uncovered configuration, the sleeve 62 and the guide bracket 72 is positioned at the stop 40S. In particular, the rear end 62B of the sleeve 62 is remote from first shoulder 40Q and is positioned adjacent to the stop 40S. Similarly, rear end 70B of the guide bracket 72 directly contacts the stop 40S and is positioned remote from the first shoulder 40Q. Such inclusion of the stop 40S provides a barrier and/or restraint of the linear movement of the cover 60 once the guide bracket 72 contacts and engages with the stop 40S.

Having now described the components of the projectile 1, methods of protecting the imaging device 50 prior to launch and unveiling the imaging device 50 during launch are discussed in greater detail below.

As the operator or technician is loading the projectile 1 onto a platform, the cover 60 is provided in the covered configuration to prevent the viewing window 50A of the imaging device 50 to be scratched or damages prior to being launched from platform. As discussed above, the cover 60 is also configured to protect the viewing window 50A from any soot or debris that is generated and ejected from neighboring or adjacent projectiles being launched from the platform.

In the covered configuration, the cover 60 completely protects the front end 40A of the housing 40 (as well as the first section and a portion of the second section of the housing 40) and the viewing window 50A of the imaging device 50 from the external environment surrounding the projectile 1, including soot and other debris that may be exhausted from a rocket motor of an adjacent projectile upon being launched from the platform. In this configuration, the sleeve 62, particularly the set of extensions 62H, is positioned ahead of the viewing window 50A (see FIG. 8).

Still referring to the covered configuration, the set of first flaps 64 is also positioned ahead of the viewing window 50A wherein the set of first flaps 64 creates a barrier or shield ahead of the viewing window 50A to prevent unwanted debris or soot from interacting with the viewing window 50A. The set of first flaps 64 may also be maintained at the covered configuration due to the biasing force applied to the set of first flaps 64 by the set of first biasers 67 engaged with at least the sleeve 62, the set of first flaps 64, and the plurality of first pivot pins 66. The set of second flaps 68 is also positioned inside of the passageway 62F of the sleeve 62. The set of second flaps 68 may also be maintained at the covered configuration due to the interior surface 62E of the sleeve 62 engaging with the outer surfaces 68C of the set of second flaps 68 even through a biasing force may be applied to the set of first flaps 64 by the set of second biasers 71 engaged with the set of second flaps 68 (see FIG. 9).

Once the projectile 1 is launched from the platform, the initial impulse or acceleration generated by the rocket motor 10 of the projectile 1 is transferred along the length of the projectile 1 and is applied to the housing 40; such impulse that is applied to the housing 40 is denoted by an arrows labeled "A" in FIGS. 10A-10D and 12. With such impulse, the housing 40 begins to apply a force against the cover 60 to transition the components of the cover 60 from the covered configuration to the uncovered configuration. As best seen in FIG. 10A, the sleeve 62 begins to move along the second outer surface 40N of the housing 40 in an opposite or reactionary direction from the first shoulder 40Q towards the stop 40S; such movement of the sleeve 62 along the housing 40 is denoted by an arrow labeled "B" in FIGS. 10A-10B. During this stage, the guide bracket 72 guides and/or leads the sleeve 62 along the housing 40 in the reactionary direction due to the interaction between the set of guide prongs 72F and the housing 40 inside of set of grooves 40T. The guide bracket 72 will guide the sleeve 62 along the housing 40 until the rear end 72B of the guide bracket 72 directly contacts the stop 40S of the housing 40.

As the sleeve 62 begins to transition from the first shoulder 40Q towards the stop 40S, the first outer surface 40H of the housing 40 presses against the inner surfaces 64D of the set of first flaps 64 since the set of first flaps 64 is attached with the sleeve 62. As best seen in FIGS. 10A-10B, each flap of the set of first flaps 64 pivots and/or rotates about a corresponding pivot pin of the plurality of first pivot pins 66 as each flap of the set of first flaps 64 passes over and is pressed outwardly away from one another by the first outer surface 40H of the housing 40; such pivoting of the set of first flaps 64 about the plurality of first pivot pins 66 is denoted by an arrow labeled "C1" in FIGS. 10A-10B. Each flap of the set of first flaps 64 continues to the ride along the first outer surface 40H of the housing 40 until each flap of the set of first flaps 64 pivots down into the set of cutouts 40G defined by the housing 40; such downward pivoting movement of the set of first flaps 64 is denoted by an arrow labeled "C2" in FIG. 10C. It should be noted that if a biaser operably engages with each flap of the set of first flaps 64 and each pivot pin of the plurality first pivot pins 66, the biasing force applied by each biaser is overcame by the impulse generated by the rocket motor 10 causing the sleeve 62 and the set of first flaps 64 to transition from the covered configuration to the uncovered configuration.

Figure 11:
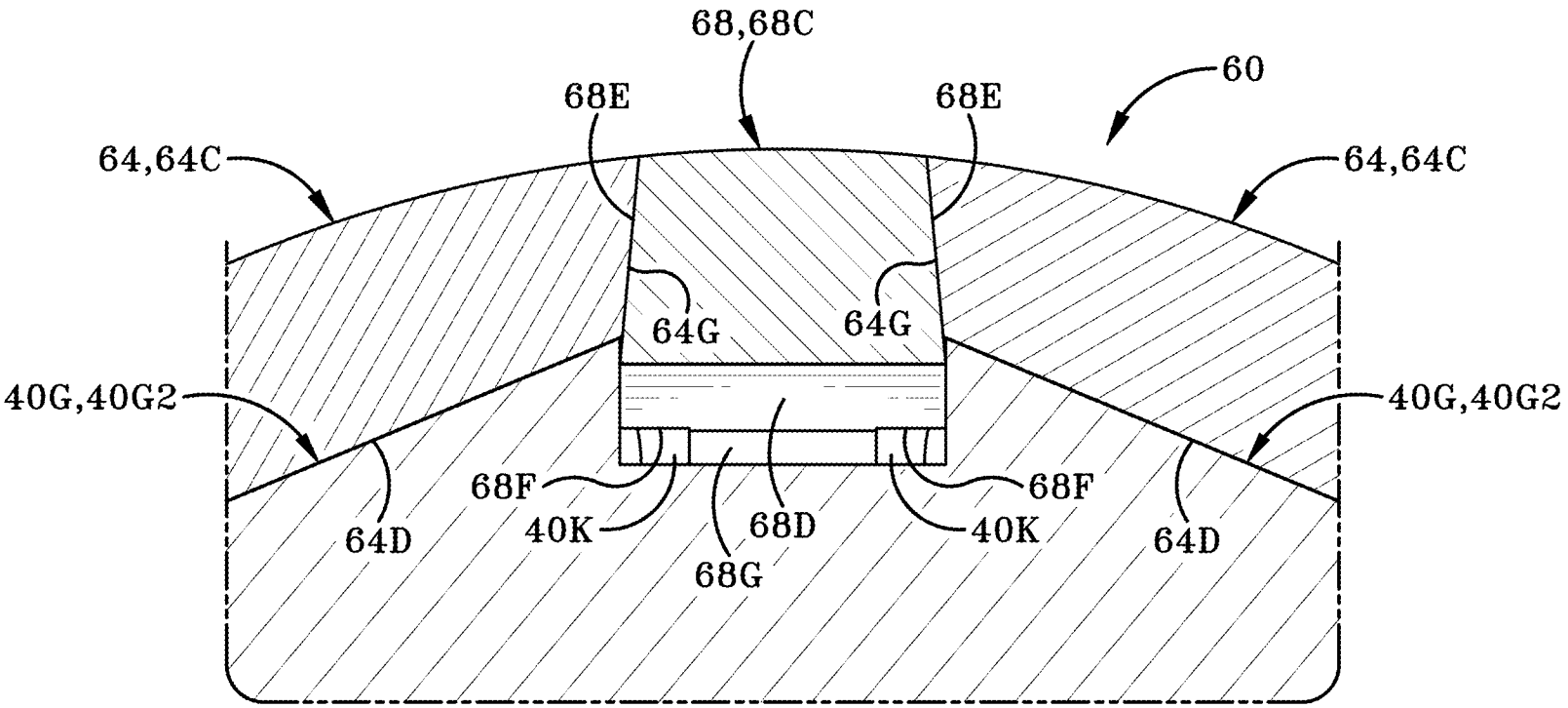
FIG. 11 is sectional view taken in the direction of line 11-11 shown in FIG. 10D.

As the sleeve 62 transitions from the first shoulder 40Q towards the stop 40S, the interior surface 62E also begins to disengage from the outer surfaces 68C of the set of second flaps 68. As best seen in FIG. 10D, each flap of the set of second flaps 68 pivots and/or rotates about a corresponding pivot pin of the plurality of second pivot pins 70 once the sleeve 62 is slidably removed from the set of second flaps 68 due to biasing force applied by a biaser operably engaged with each flap of the set of second flaps 68 and each pivot pin of the plurality of second pivot pins 70; such pivoting of the set of second flaps 68 about the corresponding pivot pin of the plurality of second pivot pins 70 is denoted by an arrow labeled "D" in FIG. 10D. Each flap of the set of second flaps 68 continues to pivot outwardly from the set of cavities 40M and away from the housing 40 until each flap of the set of second flaps 68 is positioned between and frictionally fits with two adjacent flaps of the set of first flaps 64 (see FIG. 11). Each flap of the set of second flaps 68 also continues to pivot outwardly from the set of cavities 40M and away from the housing 40 until the base 68B engages with the housing 40 (see FIG. 10D).

Once the cover 60 is provided in the uncovered position, the outer surfaces of the housing 40, the viewing window 50A of the imaging device 50, and the cover 60 collectively define continuous and uninterrupted surface along the front portion of the projectile 1 to maintain flight aerodynamics of the projectile 1. Particularly, the first outer surface 40H of the housing 40, the outer surface of the viewing window 50A of the imaging device 50, the exterior surface 62D of the sleeve 62, the outer surfaces 64C of the set of first flaps 64, the outer surfaces 68C of the set of second flaps 68, and the outer circumferential surface 72C of the guide bracket 72 collectively define a continuous and uninterrupted surface along the front portion of the projectile 1 to maintain flight aerodynamics of the projectile 1. At this stage, the viewing window 50A of the imaging device 50 is free from being impeded with or shielded by the cover 60 and may view the far field environment that surrounds the projectile 1 in flight.

Figure 13:
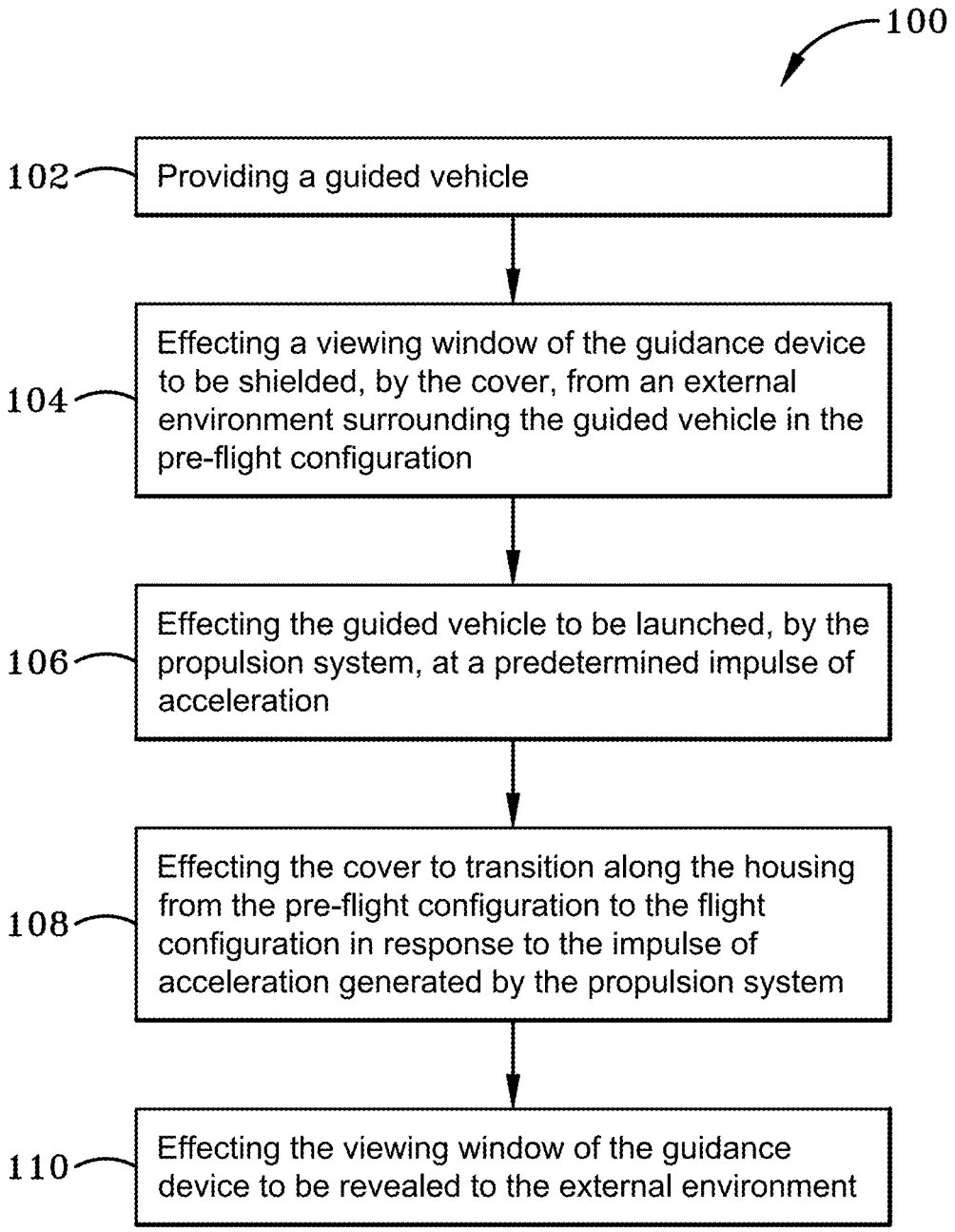
FIG. 13 is an exemplary method flowchart.

FIG. 13 illustrates a method 100. An initial step 102 of method 100 includes providing a guided vehicle, wherein the guided vehicle includes a body, a propulsion system operably engaged inside of the body, and at least one guidance kit operably engaged with the body and includes at least a housing, a guidance device operably engaged with the housing, and a cover moveably engaged with the housing between a pre-flight configuration and a flight configuration. Another step 104 of method 100 includes effecting a viewing window of the guidance device to be shielded, by the cover, from an external environment surrounding the guided vehicle in the pre-flight configuration. Another step 106 of method 100 includes effecting the guided vehicle to be launched, by the propulsion system, at a predetermined impulse of acceleration. Another step 108 of method 100 includes effecting the cover to transition along the housing from the pre-flight configuration to the flight configuration in response to the impulse of acceleration generated by the propulsion system. Another step 110 of method 100 includes effecting the viewing window of the guidance device to be revealed to the external environment.

In other exemplary embodiments, method 100 may include additional and/or optional steps. An optional step of method 100 may further include that the step of effecting the cover to transition along the housing from the pre-flight configuration to the flight configuration further comprises: effecting a sleeve of the cover to slide along an outer surface of the housing. Optional steps of method 100 may further include that the step of effecting the cover to transition along the housing from the pre-flight configuration to the flight configuration further comprises: effecting a set of first flaps to slide along the outer surface of the housing in conjunction with the sleeve; and effecting each flap of the set of first flaps to pivot outwardly in response to each flap of the set of first flaps traveling over the outer surface of the housing. An optional step of method 100 may further include effecting a set of first flaps to be biased, by a set of biasers, to the pre-flight configuration. An optional step of method 100 may further include effecting a set of first flaps to store into a set of cutouts defined in the housing when the cover is provided in the flight configuration; wherein the set of first flaps and an outer surface of the housing collectively define a continuous surface. An optional step of method 100 may further include effecting a set of second flaps to be biased, by a set of biasers, outwardly away from the housing in response to the sleeve being removed from the set of second flaps. An optional step of method 100 may further include effecting spaces to be filled in, by the set of second flaps, defined between adjacent flaps of the first set of flaps; wherein the set of first flaps, the set of second flaps, and the outer surface of the housing collectively define a continuous surface when the cover is provided in the flight configuration.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of components A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A guided vehicle, comprising:

a body;

a propulsion system operably engaged inside of the body;

a housing operably engaged with the body and encasing a guidance device inside of the housing;

a viewing window of the guidance device; and a cover moveably engaged with the housing, wherein the cover is moveable between a pre-flight configuration and a flight configuration, wherein the cover covers the viewing window in the pre-flight configuration;

wherein the cover is configured to expose the viewing window in the flight configuration in response to an impulse of acceleration generated by a launch of the guided vehicle;

wherein the cover comprises:

a sleeve slidably engaged with the housing; and a set of first flaps moveably engaged with the sleeve;

a set of pivot pins, wherein each pivot pin pivotably engages one flap from the set of first flaps with the sleeve; and wherein each flap of the set of first flaps is configured to individually pivot about the corresponding pivot pin.

2. The guided vehicle of claim 1, wherein the housing comprises:

a front end;

a rear end longitudinally opposite to the front end; and a stop disposed between the front end and the rear end.

3. The guided vehicle of claim 2, wherein the sleeve is slidable between a front end position remote from the stop and a rear end position adjacent to the stop; and wherein the set of first flaps retract from the viewing window as the sleeve transitions from the front end position to the rear end position.

4. The guided vehicle of claim 2, wherein when the cover is provided in the flight configuration, the sleeve is positioned between the front end and the rear end and is engaged with the stop and the set of first flaps is retracted away from the viewing window of the guidance device by an exterior surface of the housing.

5. The guided vehicle of claim 2, wherein the housing further comprises:

a set of cutouts defined in the housing between the front end and the stop;

wherein each flap of the set of first flaps is disposed inside of a corresponding cutout of the set of cutouts and is even with an exterior surface of the housing when the cover is provided in the flight configuration.

6. The guided vehicle of claim 1, wherein the cover further comprises:

a set of biasers operably engaged with the set of first flaps and the pivot pin;

wherein the set of biasers is configured to bias the set of first flaps to the pre-flight configuration.

7. The guided vehicle of claim 3, wherein the cover further comprises:

a set of second flaps movably engaged with the housing;

a set of first pivot pins movably engaging the set of first flaps with the set of second flaps; and a set of biasers operably engaged with the set of second flaps and the set of pins;

wherein the set of biasers is configured to bias the set of second flaps to the flight configuration.

8. The guided vehicle of claim 7, wherein the second set of flaps is maintained inside of the sleeve and transitions outwardly away from the housing as the sleeve transitions from the front end position to the rear end position.

9. The guided vehicle of claim 1, further comprising:

a set of grooves defines in the housing; and at least one guide bracket operably engaged with the sleeve and with the housing inside of the set of grooves;

wherein the at least one guide bracket is configured to lead the sleeve and the set of first flaps along the housing based on the engagement between the at least one guide bracket and the housing inside of the set of grooves.

10. A protective cover kit for a guided vehicle, comprising:

a guidance device having a viewing window;

a housing configured to encase the guidance device; and a cover moveably engaged with the housing between a pre-flight configuration and a flight configuration, wherein the cover covers the viewing window in the pre-flight configuration;

wherein the cover is configured to expose the viewing window in the flight configuration in response to an impulse of acceleration generated by a launch of the guided vehicle;

wherein the cover comprises:

a sleeve slidably engaged with the housing;

a set of first flaps moveably engaged with the sleeve a set of pivot pins, wherein each pivot pin pivotably engages one flap from the set of first flaps with the sleeve;

wherein each flap of the set of first flaps is configured to individually pivot about the corresponding pivot pin.

11. The protective cover kit of claim 10, wherein the housing comprises:

a front end;

a rear end longitudinally opposite to the front end; and a stop disposed between the front end and the rear end.

12. The protective cover kit of claim 11, wherein the sleeve is slidable between a front end position remote from the stop and a rear end position adjacent to the stop; and wherein the set of first flaps retract from the viewing window as the sleeve transitions from the front end position to the rear end position.

13. The protective cover kit of claim 10, wherein the cover further comprises:

a set of biasers operably engaged with the set of first flaps and the pivot pin;

wherein the set of biasers is configured to bias the set of first flaps to the pre-flight configuration.

14. The protective cover kit of claim 10, wherein the cover further comprises:

a set of second flaps movably engaged with the housing;

a set of first pivot pins movably engaging the set of first flaps with the set of second flaps; and a set of biasers operably engaged with the set of second flaps and the set of pins;

wherein the set of biasers is configured to bias the set of second flaps to the flight configuration.

15. A method, comprising steps of:

providing a projectile, the projectile comprising:

a body;

a propulsion system operably engaged inside of the body;

providing a protective cover kit, the protective cover kit comprising:

a guidance device having a viewing window;

a housing configured to encase the guidance device; and a cover moveably engaged with the housing between a pre-flight configuration and a flight configuration;

wherein the cover comprises:

a sleeve slidably engaged with the housing;

a set of first flaps moveably engaged with the sleeve a set of pivot pins, wherein each pivot pin pivotably engages one flap from the set of first flaps with the sleeve;

wherein each flap of the set of first flaps is configured to individually pivot about the corresponding pivot pin;

protecting the viewing window by the cover in the pre-flight configuration; and engaging the protective cover kit with the body of the projectile.

16. The method of claim 15, wherein the step of engaging the protective cover kit with the body further comprises:

threading the housing of the protective cover kit with the body of the projectile.

* * * * *